US009414454B2

(12) United States Patent
Brandes et al.

(10) Patent No.: US 9,414,454 B2
(45) **Date of Patent: *Aug. 9, 2016**

(54) SOLID STATE LIGHTING APPARATUSES AND RELATED METHODS

(71) Applicant: Cree, Inc., Durham, NC (US)

(72) Inventors: George R. Brandes, Raleigh, NC (US); Robert D. Underwood, Santa Barbara, CA (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/769,277

(22) Filed: Feb. 15, 2013

(65) Prior Publication Data

US 2014/0232289 A1 Aug. 21, 2014

(51) Int. Cl.
*H05B 33/08* (2006.01)

(52) U.S. Cl.
CPC ..... *H05B 33/083* (2013.01); *H05B 33/086* (2013.01)

(58) Field of Classification Search
CPC ..... H05B 1/00
USPC ..... 315/250, 252
See application file for complete search history.

(56) References Cited

U.S. PATENT DOCUMENTS 5,941,626 A 8/1999 Yamuro
6,498,440 B2 12/2002 Stam et al.
6,580,228 B1 * 6/2003 Chen ..... F21K 9/135 257/E25.02
6,636,003 B2 10/2003 Rahm et al.
6,936,855 B1 8/2005 Harrah
7,072,096 B2 * 7/2006 Holman ..... F21S 8/08 257/E25.02
7,400,439 B2 * 7/2008 Holman ..... F21S 8/08 257/E25.02
7,791,285 B2 9/2010 Wu
7,829,899 B2 11/2010 Hutchins
7,918,581 B2 4/2011 van de Ven et al.
8,029,155 B2 10/2011 van de Ven et al.
8,188,687 B2 * 5/2012 Lee ..... H05B 33/0806 315/209 R (Continued)

FOREIGN PATENT DOCUMENTS

JP 2004-119631 A 4/2004
KR 1020120103781 A 9/2012

(Continued)

OTHER PUBLICATIONS

Co-pending U.S. Appl. No. 13/769,273, filed Feb. 15, 2013.

(Continued)

*Primary Examiner* — Douglas W Owens
*Assistant Examiner* — Srinivas Sathiraju
(74) *Attorney, Agent, or Firm* — Withrow & Terranova, P.L.L.C.; Vincent K. Gustafson

(57) ABSTRACT

Solid state lighting apparatuses and related methods are described. In certain embodiments, a solid state lighting apparatus adapted to operate with alternating current (AC) received from an AC power source is provided. The lighting apparatus can include a substrate and an array of solid state light emitters arranged on or supported by the substrate. Multiple solid state light emitter sets of the array can be arranged to be activated and/or deactivated at different times relative to one another during a portion of an AC cycle. The lighting apparatus can also include at least one reflective structure arranged between one or more solid state light emitters and at least one driver circuit component, to reduce or eliminate absorption by the driver circuit component(s) of light generated by the solid state light emitter(s).

40 Claims, 13 Drawing Sheets

(56) References Cited

U.S. PATENT DOCUMENTS 8,314,571 B2 11/2012 Jonsson
8,382,315 B2 * 2/2013 Lee ..... F21V 23/02 362/217.08
8,395,332 B2 * 3/2013 Lee ..... H05B 33/0806 315/291
8,491,140 B2 7/2013 Van De Ven et al.
8,716,946 B2 * 5/2014 Lee ..... H05B 33/0806 315/209 R
8,860,331 B2 * 10/2014 Lee ..... H05B 33/0806 315/291
8,866,417 B2 * 10/2014 Lee ..... H05B 33/0806 315/209 R
8,896,216 B2 * 11/2014 Lee ..... H05B 33/0824 315/153
9,000,676 B2 * 4/2015 Radermacher ..... H05B 33/0824 315/209 R
2004/0046510 A1 3/2004 Allen
2004/0105264 A1 * 6/2004 Spero ..... B60Q 1/04 362/276
2004/0130518 A1 7/2004 De Krijger et al.
2005/0162101 A1 * 7/2005 Leong ..... F21K 9/00 315/291
2005/0174473 A1 * 8/2005 Morgan ..... F21S 48/325 348/370
2006/0022214 A1 * 2/2006 Morgan ..... F21K 9/00 257/99
2007/0228999 A1 * 10/2007 Kit ..... F21K 9/17 315/291
2008/0211416 A1 * 9/2008 Negley ..... H01L 27/15 315/193
2008/0211421 A1 * 9/2008 Lee ..... H05B 33/0806 315/250
2008/0290814 A1 * 11/2008 Leong ..... F21K 9/00 315/294
2009/0161356 A1 6/2009 Negley et al.
2009/0167202 A1 7/2009 Miskin et al.
2009/0283779 A1 11/2009 Negley et al.
2009/0316393 A1 12/2009 Vissenberg et al.
2010/0102743 A1 * 4/2010 Hou et al. ..... 315/250
2010/0103660 A1 4/2010 van de Ven et al.
2010/0103678 A1 4/2010 van de Ven et al.
2010/0127283 A1 5/2010 van de Ven et al.
2010/0134016 A1 * 6/2010 York ..... F21K 9/54 315/113
2010/0176743 A1 * 7/2010 Lee ..... F21V 23/02 315/294
2010/0207851 A1 8/2010 Cok et al.
2010/0277084 A1 * 11/2010 Lee ..... H05B 33/0806 315/192
2010/0283072 A1 * 11/2010 Kazlas ..... G02B 6/005 257/98
2011/0031891 A1 * 2/2011 Lee ..... H05B 33/0806 315/250
2011/0037413 A1 2/2011 Negley et al.
2011/0068701 A1 3/2011 van de Ven et al.
2011/0176289 A1 7/2011 Ramer et al.
2011/0182065 A1 7/2011 Negley et al.
2011/0193487 A1 8/2011 Janik
2011/0273102 A1 11/2011 van de Ven et al.
2011/0298371 A1 12/2011 Brandes et al.
2012/0091920 A1 4/2012 Yang
2012/0092865 A1 4/2012 Farmer
2012/0099084 A1 * 4/2012 Toyooka ..... G03B 21/14 353/85
2012/0099321 A1 4/2012 Scott et al.
2012/0120655 A1 5/2012 Scott et al.
2012/0201022 A1 8/2012 van de Ven et al.
2012/0201024 A1 8/2012 van de Ven et al.
2012/0206050 A1 * 8/2012 Spero ..... B60Q 1/04 315/152
2012/0206064 A1 * 8/2012 Archenhold ..... H05B 33/0812 315/297
2012/0217885 A1 * 8/2012 Lee ..... H05B 33/0806 315/192
2013/0009553 A1 * 1/2013 Lee ..... H05B 33/0824 315/153
2013/0026923 A1 * 1/2013 Athalye ..... H05B 33/083 315/113
2013/0026925 A1 1/2013 Ven et al.
2013/0043799 A1 2/2013 Siu et al.
2013/0049602 A1 * 2/2013 Raj ..... H05B 33/0869 315/151
2013/0069535 A1 3/2013 Athalye
2013/0069536 A1 3/2013 Ni
2013/0088848 A1 * 4/2013 Lee ..... F21V 29/713 362/84
2013/0169159 A1 7/2013 Lys
2013/0169174 A1 * 7/2013 Lee ..... H05B 33/0806 315/192
2013/0200812 A1 * 8/2013 Radermacher ..... H05B 33/08 315/186
2014/0028204 A1 * 1/2014 Lee ..... H05B 33/0806 315/186
2014/0078715 A1 3/2014 Pickard et al.
2014/0125229 A1 5/2014 Ni

FOREIGN PATENT DOCUMENTS

WO WO-2011/108876 A2 9/2011
WO WO-2013/052403 A1 4/2013

OTHER PUBLICATIONS

Non-final Office Action for U.S. Appl. No. 13/769,273 mailed May 20, 2014, 16 pages.
International Search Report and Written Opinion for International Patent Application No. PCT/US2014/014217 mailed May 22, 2014, 23 pages.
Notice of Allowance for U.S. Appl. No. 13/769,273, mailed Oct. 22, 2014, 12 pages.
International Preliminary Report on Patentability for International Patent Application No. PCT/US2014/014217, mailed Aug. 27, 2015, 18 pages.

* cited by examiner

SOLID STATE LIGHTING APPARATUSES AND RELATED METHODS

STATEMENT OF RELATED APPLICATIONS

Subject matter disclosed herein relates at least in part to U.S. patent application Ser. No. 13/192,755 (published as U.S. Patent Application Publication No. 2013/0026925), U.S. patent application Ser. No. 13/339,974, U.S. patent application Ser. No. 13/235,103, U.S. patent application Ser. No. 13/235,127, and U.S. patent application Ser. No. 13/360,145. The disclosures of the foregoing patent applications are hereby incorporated by reference as if set forth fully herein.

TECHNICAL FIELD

The present subject matter generally relates to lighting apparatuses and related methods and, more particularly, to solid state lighting apparatuses and related methods.

BACKGROUND

Solid state lighting arrays are used for a number of lighting applications. For example, lighting panels including arrays of solid state light emitting devices have been used as direct illumination sources in applications including architectural and/or accent lighting. A solid state light emitting device may include, for example, a packaged light emitting device including one or more light emitting diodes (LEDs) or LED chips, which may include inorganic LED chips and/or organic LED chips (OLEDs). Typically, solid state light emitting devices generate light through the recombination of electronic carriers (electrons and holes) in a light emitting layer or region of a LED chip. LED chips have significantly longer lifetimes and typically have significantly greater luminous efficiency than conventional incandescent and fluorescent light sources; however, LED chips are narrow-band emitters, and it can be challenging to simultaneously provide good color rendering in combination with high luminous efficacy while maintain a maximizing brightness and efficiency.

Aspects relating to the subject matter disclosed herein may be better understood with reference to the 1931 CIE (Commission International de l'Eclairage) Chromaticity Diagram, which is well-known and readily available to those of ordinary skill in the art. The 1931 CIE Chromaticity Diagram maps out the human color perception in terms of two CIE parameters x and y. The spectral colors are distributed around the edge of the outlined space, which includes all of the hues perceived by the human eye. The boundary line represents maximum saturation for the spectral colors. The chromaticity coordinates (i.e., color points) that lie along the blackbody locus obey Planck's equation: $E(\lambda)=A\lambda^{-5}/(e^{B/T}-1)$, where E is the emission intensity, $\lambda$ is the emission wavelength, T the color temperature of the blackbody, and A and B are constants. Color coordinates that lie on or near the blackbody locus yield pleasing white light to a human observer. The 1931 CIE Diagram includes temperature listings along the blackbody locus (embodying a curved line emanating from the right corner). These temperature listings show the color path of a blackbody radiator that is caused to increase to such temperatures. As a heated object becomes incandescent, it first glows reddish, then yellowish, then white, and finally bluish. This occurs because the wavelength associated with the peak radiation of the blackbody radiator becomes progressively shorter with increased temperature, consistent with the Wien Displacement Law. Illuminants which produce light that is on or near the blackbody locus can thus be described in terms of their color temperature.

LED apparatuses typically receive a direct current (DC) input signal or a modulated square wave input signal so that a constant current flows through the LED chips when in an "on" state. A current value is typically set to provide high conversion efficiency. LED light sources with variable intensity may be controlled by changing duty factor of a modulated square wave input signal.

Conventional lighting systems for use in buildings are powered by an alternating current (AC) source; accordingly, a LED-based light source for use in buildings typically includes an AC-DC power converter. An AC-DC power converter often represents a significant fraction of the overall cost of a LED-based light source, and power losses inherent to such a power converter reduces overall efficiency of the light source. Additionally, AC-DC power converters are generally not as reliable as LED chips, and therefore can limit the operating lifetime of a LED light source.

To avoid disadvantages associated with use of AC-DC power converters, it has been proposed to operate a LED light source directly from an AC power source without AC-DC conversion. Multiple groups or sets of series-connected LED chips may be powered by different portions of an AC waveform. For instance, one group may be powered on when the amplitude of the AC waveform is positive, and another group may be powered on when the amplitude of the AC waveform is negative; however, this simple driving scheme typically suffers from flicker and reduced efficiency. To provide somewhat improved efficiency, a full-wave rectifier may be used; however, the resulting light source still has limited efficiency and may exhibit flicker.

Elimination of AC-DC power converters from solid state lighting apparatuses may enable enhanced cost and packaging efficiencies. It would be desirable to provide solid state lighting apparatuses with reduced volume (or size) and increased integration of functional components (e.g., including but not limited to driver components), in order to reduce production cost and provide lighting device designers with enhanced packaging flexibility, thereby promoting consumer adoption of solid state lighting devices. Achieving a high degree of functional component integration in lighting apparatuses may require placement of functional components proximate to solid state light emitter (e.g., LED) chips, thereby providing potential for such functional components to block, absorb, trap, or otherwise interfere with light emitted by one or more LED chips. It would be desirable to achieve a high degree of functional component integration in such solid state light emitting apparatuses while avoiding physical interference between light emissions and functional components in order to enhance light extraction and provide increased light intensity. Avoiding of such interference may enable reduction in the number of LED chips required per solid state lighting apparatus, thereby reducing heatsink requirements and reducing cost. Challenges persist in maximizing light extraction while reducing the number of LED chips required per solid state lighting apparatus.

Accordingly, a need exists for improved solid state lighting apparatuses and/or improved methods including use of solid state lighting apparatuses that can be directly coupled to an AC voltage signal, without requiring use of an on-board switched mode power supply. Desirable solid state lighting apparatuses and methods would exhibit improved light extraction, brightness, and/or improved thermal management. Desirable apparatuses and methods would also exhibit reduced cost and make it easier for end-users to justify switching to LED products from a return on investment or payback perspective.

SUMMARY

Solid state lighting apparatuses adapted to operate with alternating current (AC) received directly from an AC power source and related methods are disclosed. In certain embodiments an exemplary solid state lighting apparatus can comprise a substrate and multiple sets of one or more solid state light emitters disposed over arranged on or supported by the substrate. In certain embodiments, at least first and second sets of the multiple sets of solid state light emitters can be configured to be activated and/or deactivated at different times relevant to one another during a portion of an AC cycle. In certain embodiments, the first and second sets of the multiple sets of solid state light emitters can also comprise different duty cycles. Various apparatuses disclosed herein may include elements and/or configurations arranged to reduce physical interference between solid state light emitters and functional components (e.g. driver circuit components), thereby enhancing light extraction.

In one aspect, a solid state lighting apparatus is adapted to operate with alternating current (AC) received from an AC power source, the lighting apparatus comprising: a substrate; an array of solid state light emitters arranged on or supported by the substrate, the array comprising a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; at least one driver circuit component arranged on or over the substrate and arranged to drive the array of solid state light emitters; and at least one reflective structure positioned between one or more solid state light emitters of the array of solid state light emitters and the at least one driver circuit component and arranged to reduce or eliminate absorption by the at least one driver circuit component of light generated by the one or more solid state light emitters.

In another aspect, a solid state lighting apparatus is adapted to operate with alternating current (AC) received from an AC power source, the lighting apparatus comprising: a substrate; an array of solid state light emitters arranged on or supported by the substrate, the array comprising a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; at least one driver circuit component arranged on or over the substrate and arranged to drive the array of solid state light emitters; and a reflective coating arranged over at least a portion of the at least one driver circuit component.

In another aspect, a solid state lighting apparatus is adapted to operate with alternating current (AC) received from an AC power source, the lighting apparatus comprising: a substrate including a first surface, a second surface opposing the first surface, electrical traces arranged on or over the first surface, and electrical traces arranged on or over the second surface; an array of solid state light emitters arranged on or over the first surface, the array comprising a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; and at least one driver circuit component arranged on or over the second surface and arranged to drive the array of solid state light emitters.

In another aspect, a solid state lighting apparatus is adapted to operate with alternating current (AC) received from an AC power source, the lighting apparatus comprising: a substrate; an array of solid state light emitters arranged on or supported by the substrate, the array comprising a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; and at least one surge protection component arranged on or over the substrate and adapted to reduce or eliminate transmission of voltage transients exceeding the line voltage to the array of solid state light emitters.

In another aspect, a solid state lighting apparatus is adapted to operate with alternating current (AC) received from an AC power source, the lighting apparatus comprising: a first array of solid state light emitters including a first plurality of solid state light emitter sets each comprising multiple solid state light emitters arranged in or on a first elongated body structure, wherein at least two different solid state light emitter sets of the first plurality of individually controllable solid state light emitter sets are arranged to be activated and/or deactivated at different times relative to one another during a portion of an AC cycle; at least one driver circuit component arranged to drive the first array of solid state light emitters; and at least one electrical connector arranged to permit electrical communication between the first array of solid state light emitters and a second array of solid state light emitters that includes a second plurality of solid state light emitter sets each comprising multiple solid state light emitters arranged in or on a second elongated body structure, wherein at least two different solid state light emitter sets of the second plurality of solid state light emitter segments are arranged to be activated and/or deactivated at different times relative to one another during the portion of the AC cycle, with a first solid state light emitter set of the first array of solid state light emitters in electrical communication with a first solid state light emitter set of the second array of solid state light emitters, and with a second solid state light emitter set of the first array of solid state light emitters in electrical communication with a second solid state light emitter set of the second array of solid state light emitters.

In another aspect, a solid state lighting apparatus is adapted to operate with alternating current (AC) received from an AC power source, the lighting apparatus comprising: a substrate; an array of solid state light emitters arranged on or supported by the substrate, the array comprising a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; and at least one optical element comprising a lens and/or a diffuser arranged to receive emissions from each solid state light emitter of the array of solid state light emitters.

In another aspect, a solid state lighting apparatus is adapted to operate with alternating current (AC) received from an AC power source, the lighting apparatus comprising: a base end; a light-transmissive end opposing the base end; an array of solid state light emitters including a plurality of solid state light emitter sets each comprising multiple solid state light emitters, wherein at least two different solid state light emitter sets of the plurality of individually controllable solid state light emitter segments are arranged to be activated and/or deactivated at different times relative to one another during a portion of an AC cycle; and a reflector comprising including a cavity and a reflective surface arranged to permit transmission of light reflected by the reflector toward the light-transmissive end; wherein the array of solid state emitters is arranged in or above the cavity to transmit emissions of the solid state emitters toward the reflective surface; and wherein the array of solid state emitters are arranged to emit light in a direction toward the base end to impinge on the reflective surface for reflection of light toward the light-transmissive end.

In another aspect, a solid state lighting apparatus is adapted to operate with alternating current (AC) received from an AC power source, the lighting apparatus comprising: A lighting apparatus adapted to operate with alternating current (AC) received from an AC power source, the lighting device comprising: a light-transmissive end; an array of solid state light emitters including a plurality of solid state light emitter sets each comprising multiple solid state light emitters, wherein at least two different solid state light emitter sets of the plurality of individually controllable solid state light emitter sets are arranged to be activated and/or deactivated at different times relative to one another during a period of the AC waveform; and a reflector defining a cavity and comprising a reflective surface arranged to permit transmission of light reflected by the reflector toward the light-transmissive end; wherein the array of solid state emitters is arranged in or above the cavity to transmit emissions of the solid state emitters toward the reflective surface; and wherein light emissions transmitted through the light-transmissive end comprise emissions reflected by the reflective surface and are devoid of direct emissions from the array of solid state emitters.

In another aspect, a method comprises illuminating an object, a space, or an environment, utilizing a lighting apparatus as described herein.

In another aspect, any of the foregoing aspects, and/or various separate aspects and features as described herein, may be combined for additional advantage. Any of the various features and elements as disclosed herein may be combined with one or more other disclosed features and elements unless indicated to the contrary herein.

Other aspects, features and embodiments of the invention will be more fully apparent from the ensuing disclosure and appended claims.

BRIEF DESCRIPTION OF DRAWINGS

A full and enabling disclosure of the present subject matter is set forth more particularly in the remainder of the specification, including reference to the accompanying figures, relating to one or more embodiments, in which.

DETAILED DESCRIPTION

Figure 1:
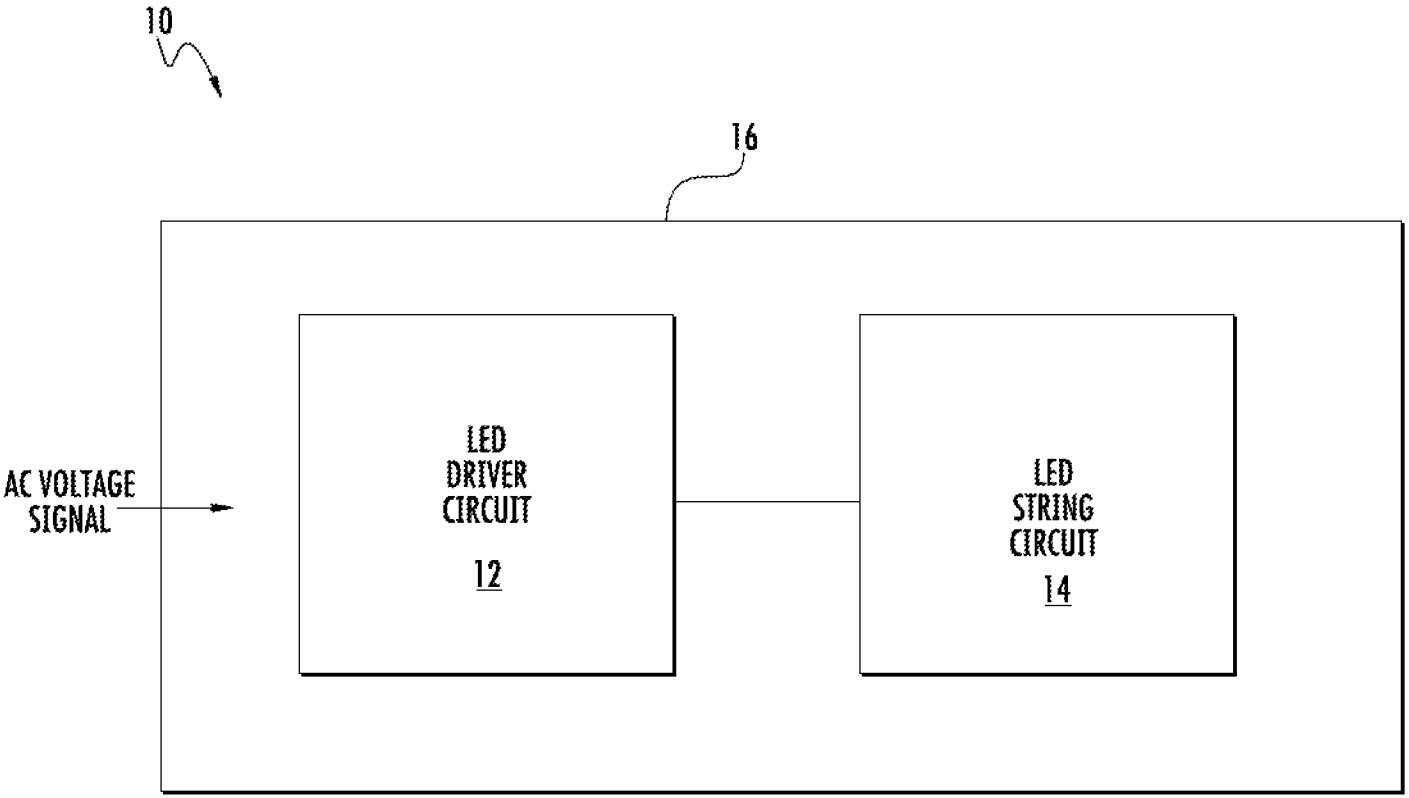
FIG. 1 is a schematic block diagram illustrating a solid state lighting apparatus including a light emitting diode (LED) driver circuit and an LED string circuit according to certain embodiments.

The present invention relates in certain aspects to solid state lighting apparatuses adapted to operate with alternating current (AC) received directly from an AC power source and related methods. Exemplary solid state lighting apparatuses can comprise a substrate and multiple sets of one or more solid state light emitters arranged on or supported by the substrate. At least first and second sets of the multiple sets of solid state light emitters can be configured to be activated and/or deactivated at different times relevant to one another during a portion of an AC cycle. More than two sets of solid state light emitters may be provided, and different sets of solid state light emitters may also comprise different duty cycles. Various apparatuses disclosed herein may include elements and/or configurations arranged to reduce physical interference between solid state light emitters and functional components (e.g., driver circuit components), thereby enhancing light extraction.

In certain embodiments, solid state lighting apparatuses described herein may include various emitter configurations, color combinations, and/or circuit components adapted to reduce perceivable flicker, perceivable color shifts, and/or perceivable spatial variations in luminous flux that could potentially occur during activation and/or deactivation of multiple sets of different solid state light emitters.

Unless otherwise defined, temis used herein should be construed to have the same meaning as commonly understood by one of ordinary skill in the art to which this invention belongs. It will be further understood that terms used herein should be interpreted as having a meaning that is consistent with their meaning in the context of this specification and the relevant art, and should not be interpreted in an idealized or overly formal sense unless expressly so defined herein.

Embodiments of the invention are described herein with reference to cross-sectional, perspective, elevation, and/or plan view illustrations that are schematic illustrations of idealized embodiments of the invention. Variations from the shapes of the illustrations as a result, for example, of manufacturing techniques and/or tolerances, are to be expected, such that embodiments of the invention should not be construed as limited to particular shapes illustrated herein. This invention may be embodied in different forms and should not be construed as limited to the specific embodiments set forth herein. In the drawings, the size and relative sizes of layers and regions may be exaggerated for clarity.

Unless the absence of one or more elements is specifically recited, the terms "comprising," "including," and "having" as used herein should be interpreted as open-ended terms that do not preclude the presence of one or more elements.

It will be understood that when an element such as a layer; region; or substrate is referred to as being "on" another element, it can be directly on the other element or intervening elements may be present. Moreover, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the device in addition to the orientation depicted in the figures. For example, if the device in the figures is turned over, structure or portion described as "above" other structures or portions would now be oriented "below" the other structures or portions.

The terms "electrically activated emitter" and "emitter" as used herein refers to any device capable of producing visible or near visible (e.g.; from infrared to ultraviolet) wavelength radiation, including but not limited to, xenon lamps, mercury lamps, sodium lamps, incandescent lamps, and solid state emitters, including light emitting diodes (LEDs or LED chips), organic light emitting diodes (OLEDs), and lasers.

The terms "solid state light emitter" or "solid state emitter" may include a light emitting diode, laser diode, organic light emitting diode, and/or other semiconductor device preferably arranged as a semiconductor chip that includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials.

It will be understood that the terms "groups", "segments", or "sets" as used herein are synonymous terms. As used herein, these terms generally describe how multiple LED chips can be electrically connected in series, in parallel, or in mixed series/parallel configurations among mutually exclusive groups/segments/sets.

The term "substrate" as used herein in connection with lighting apparatuses refers to a mounting element on which, in which, or over which multiple solid state light emitters (e.g., emitter chips) may be arranged or supported (e.g., mounted). Exemplary substrates useful with lighting apparatuses as described herein include printed circuit boards (including but not limited to metal core printed circuit boards, flexible circuit boards, dielectric laminates, and the like) having electrical traces arranged on one or multiple surfaces thereof, support panels, and mounting elements of various materials and conformations arranged to receive, support, and/or conduct electrical power to solid state emitters. A unitary substrate may be used to support multiple groups of solid state emitter components, and may further be used to support related circuits and/or circuit elements; such as driver circuit elements, rectifier circuit elements (e.g., a rectifier bridge), current limiting circuit elements, current diverting circuit elements, and/or dimmer circuit elements. In certain embodiments, a substrate may include multiple emitter mounting regions each arranged to receive one or more solid state light emitters or sets of solid state light emitters. In certain embodiments, a substrate (e.g., such as a circuit board) may include a first surface and an opposing second surface, with an array of solid state emitters arranged on or over the first surface, and with at least one driver circuit component (more preferably all driver circuit components) arranged on or over the second surface, with such configuration reducing or eliminating impingement of light on, or absorption of light by, the at least one driver circuit component. In certain embodiments, substrates may include conductive regions arranged to conduct power to solid state light emitters or solid state light emitter groups arranged thereon or there over. In other embodiments, substrates may be insulating in character, and electrical connections to solid state emitters may be provided by other means (e.g., via conductors not associated with substrates).

Solid state light emitting devices according to embodiments of the invention may include III-V nitride (e.g., gallium nitride) based LED chips or laser chips fabricated on a silicon, silicon carbide, sapphire, or III-V nitride growth substrate, including (for example) devices manufactured and sold by Cree, Inc. of Durham, N.C. Such LEDs and/or lasers may be configured to operate such that light emission occurs through the substrate in a so-called "flip chip" orientation. Such LED and/or laser chips may also be devoid of growth substrates (e.g., following growth substrate removal).

LED chips useable with lighting devices as disclosed herein may include horizontal devices (with both electrical contacts on a same side of the LED chip) and/or vertical devices (with electrical contacts on opposite sides of the LED chip). A horizontal device (with or without the growth substrate), for example, may be flip chip bonded (e.g., using solder) to a carrier substrate or printed circuit board (PCB), or wire bonded. A vertical device (without or without the growth substrate) may have a first terminal solder bonded to a carrier substrate, mounting pad, or printed circuit board (PCB), and have a second terminal wire bonded to the carrier substrate, electrical element, or PCB.

Electrically activated light emitters (including solid state light emitters) may be used individually or in groups to emit one or more beams to stimulate emissions of one or more lumiphoric materials (e.g., phosphors, scintillators, lumiphoric inks, quantum dots) to generate light at one or more peak wavelength, or of at least one desired perceived color (including combinations of colors that may be perceived as white). Inclusion of lumiphoric (also called 'luminescent') materials in lighting devices as described herein may be accomplished by direct coating on lumiphor support elements or lumiphor support surfaces (e.g., by powder coating, inkjet printing, or the like), adding such materials to lenses, and/or by embedding or dispersing such materials within lumiphor support elements or surfaces. Other materials, such as light scattering elements (e.g., particles) and/or index matching materials, may be associated with a lumiphoric material-containing element or surface. LED devices and methods as disclosed herein may include have multiple LED chips of different colors, one or more of which may be white emitting (e.g., including at least one LED chip with one or more lumiphoric materials).

In certain embodiments, one or more short wavelength solid state emitters (e.g., blue and/or cyan LED chips) may be used to stimulate emissions from a mixture of lumiphoric materials, or discrete layers of lumiphoric material, including red, yellow, and green lumiphoric materials. In certain embodiments, multiple groups of solid state emitters may include at least three independently controlled short wavelength (e.g., blue or cyan) LED chips, with a first short wavelength LED chip arranged to stimulate emissions of a first red lumiphor, a second short wavelength LED chip arranged to stimulate emissions of a second yellow lumiphor, and a third short wavelength LED chip arranged to stimulate emissions of a third red lumiphor. Such LED chips of different wavelengths may be present in the same group of solid state emitters, or may be provided in different groups of solid state emitters.

The expression "peak wavelength", as used herein, means (1) in the case of a solid state light emitter, to the peak wavelength of light that the solid state light emitter emits if it is illuminated, and (2) in the case of a lumiphoric material, the peak wavelength of light that the lumiphoric material emits if it is excited.

A wide variety of wavelength conversion materials (e.g., luminescent materials, also known as lumiphors or luminophoric media, e.g., as disclosed in U.S. Pat. No. 6,600,175 and U.S. Patent Application Publication No. 2009/0184616), are well-known and available to persons of skill in the art. Examples of luminescent materials (lumiphors) include phosphors, scintillators, day glow tapes, nanophosphors, quantum dots (e.g., such as provided by NNCrystal US Corp. (Fayetteville, Ark.)), and inks that glow in the visible spectrum upon illumination with (e.g., ultraviolet) light. One or more luminescent materials useable in devices as described herein may be down-converting or up-converting, or can include a combination of both types.

Some embodiments of the present invention may use solid state emitters, emitter packages, fixtures, luminescent materials/elements, power supply elements, control elements, and/or methods such as described in U.S. Pat. Nos. 7,564,180; 7,456,499; 7,213,940; 7,095,056; 6,958,497; 6,853,010; 6,791,119; 6,600,175, 6,201,262; 6,187,606; 6,120,600; 5,912,477; 5739,554; 5,631,190; 5,604,135; 5,523,589; 5,416,342; 5,393,993; 5,359,345; 5,338,944; 5,210,051; 5,027,168; 5,027,168; 4,966,862, and/or 4,918,497, and U.S. Patent Application Publication Nos. 2009/0184616; 2009/0080185; 2009/0050908; 2009/0050907; 2008/0308825; 2008/0198112; 2008/0179611, 2008/0173884, 2008/0121921; 2008/0012036; 2007/0253209; 2007/0223219; 2007/0170447; 2007/0158668; 2007/0139923, and/or 2006/0221272; with the disclosures of the foregoing patents and published patent applications being hereby incorporated by reference as if set forth fully herein.

The expression "lighting device" or "lighting apparatus", as used herein, is not limited, except that it is capable of emitting light. That is, a lighting device or lighting apparatus can be a device or apparatus that illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or backlighting (e.g., backlight poster, signage, LCD displays), light bulbs, bulb replacements (e.g., for replacing AC incandescent lights, low voltage lights, fluorescent lights, etc.), outdoor lighting, security lighting, exterior residential lighting (wall mounts, post/column mounts), ceiling fixtures/wall sconces, under cabinet lighting, lamps (floor and/or table and/or desk), landscape lighting, track lighting, task lighting, specialty lighting, rope lights, ceiling fan lighting, archival/art display lighting, high vibration/impact lighting-work lights, etc., mirrors/vanity lighting, or any other light emitting device. In certain embodiments, lighting devices or lighting apparatuses as disclosed herein are self-ballasted.

The inventive subject matter further relates in certain embodiments to an illuminated enclosure (the volume of which can be illuminated uniformly or non-uniformly), comprising an enclosed space and at least one lighting device or lighting apparatus as disclosed herein, wherein the lighting device or apparatus illuminates at least a portion of the enclosure (uniformly or non-uniformly). The inventive subject matter further relates to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, a LCD display, a cave, a tunnel, a yard, a lamppost, etc., having mounted therein or thereon at least one lighting device as described herein. Methods include illuminating an object, a space, or an environment, utilizing one or more lighting devices or apparatuses as disclosed herein.

In certain embodiments, lighting devices or apparatuses as described herein including multiple groups of one electrically activated (e.g., solid state) light emitters with peak wavelengths in the visible range. In certain embodiments, multiple electrically activated (e.g., solid state) emitters are provided, with groups of emitters being separately controllable relative to one another. In certain embodiments, one or more groups of solid state emitters as described herein may include at least a first LED chip comprising a first LED peak wavelength, and include at least a second LED chip comprising a second LED peak wavelength that differs from the first LED peak wavelength by at least 20 nm, or by at least 30 nm. In such a case, each of the first wavelength and the second wavelength is preferably within the visible range.

In certain embodiments, control of one or more solid state emitter groups or sets may be responsive to a control signal (optionally including at least one sensor arranged to sense electrical, optical, and/or thermal properties and/or environmental conditions), and a control system may be configured to selectively provide one or more control signals to at least one current supply circuit. In various embodiments, current to different circuits or circuit portions may be pre-set, user-defined, or responsive to one or more inputs or other control parameters.

In certain embodiments, each set of solid state light emitters comprises at least one electrostatic discharge protection element in electrical communication therewith.

In certain embodiments, multiple solid state emitters (e.g., LEDs) arranged to emit similar or different peak wavelengths are arranged on a common substrate, with different individual emitters or sets of emitters being separately controllable from other individual emitters or sets of emitters. Emitters having similar output wavelengths may be selected from targeted wavelength bins. Emitters having different output wavelengths may be selected from different wavelength bins, with peak wavelengths differing from one another by a desired threshold (e.g., at least 20 nm, at least 30 nm, at least 50 nm, or another desired threshold).

In certain embodiments, one or more sets of solid state emitter includes at least one BSY or white emitter component (including a blue solid state emitter arranged to stimulate emissions of a yellow lumiphor) and at least one red emitter (e.g., a red LED and/or a LED (e.g., UV, blue, cyan, green, etc.) arranged to stimulate emissions of a red lumiphor). Addition of at least one red emitter may be useful to enhance warmth of the BSY or white emissions and improve color rendering, with the resulting combination being termed BSY+R or warm white. In certain embodiments, red and BSY components may be separately controlled, as may be useful to adjust color temperature and/or to maintain a desired color point as temperature increases. In various embodiments, BSY components and red components may be controlled together in a single group or set, or may be aggregated into separate groups or sets that are separately controlled. One or more supplemental solid state emitters and/or lumiphors of any suitable color (or peak wavelength) may be substituted for one or more red light-emitting components, or may be provided in addition to one or more red light-emitting components.

In certain embodiments, a solid state lighting device may include one or more groups or sets of BSY light emitting components supplemented with one or more supplemental emitters, such as long wavelength blue, cyan, green, yellow, amber, orange, red or any other desired colors. Presence of a cyan solid state emitter (which is preferably independently controllable) is particularly desirable in certain embodiments to permit adjustment or tuning of color temperature of a lighting device, since the tie line for a solid state emitter having a ~487 nm peak wavelength is substantially parallel to the blackbody locus for a color temperature of less than 3000K to about 4000K. Different groups of solid state light emitters are preferably controlled separately, such as may be useful to adjust intensity, permit tuning of output color, permit tuning of color temperature, and/or affect dissipation of heat generated by the light emitting components.

In certain embodiments, a solid state lighting apparatus adapted to operate with alternating current (AC) received from an AC power source, can include an array of solid state light emitters arranged on or over a substrate, at least one driver circuit component arranged on or over the substrate to drive the array of solid state light emitters, and at least one reflective structure arranged between one or more solid state light emitters of the array and the at least one driver circuit component for reducing or eliminating absorption by the at least one driver circuit component of light generated by the one or more solid state light emitters. Such configuration can increase light extraction and enhance light output from the solid state lighting apparatus. The array of solid state emitters may include a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle.

In certain embodiments, the lighting apparatus can include a substrate having a plurality of electrically conductive traces along at least one face of the substrate.

When a lighting apparatus as described herein includes at least one reflective structure, in certain embodiments the reflective structure can include at least one raised element adhered to or deposited on the first face of the substrate. In certain embodiments, the at least one reflective structure can include a plurality of reflective structures. In certain embodiments, the at least one reflective structure can be arranged on or over at least a portion of at least one driver circuit element or component. In certain embodiments, at least one reflective structure may be diffusively reflective. In certain embodiments, at least one reflective structure may be specularly reflective. In certain embodiments, the at least one reflective structure may comprise at least one of a white color and a silver color. In certain embodiments, at least one reflective structure may comprise silicone that can be molded and at least partially cured. In certain embodiments, at least one reflective structure may comprise a diffuser. In certain embodiments, the reflective structure may comprise a lens. In certain embodiments, at least one other (or additional) reflective structure may be disposed along or bound at least a portion of a lens. Such a reflective structure may optionally extend outward or upward from the lens. In certain embodiments, at least one reflective structure may comprise a dispensed silicone wing, dam, or damlet disposed about portions of, or all of, a centrally disposed lens. In certain embodiments, at least one reflective structure may comprise a reflective coating. In certain embodiments, a lighting apparatus as described herein may be devoid of any AC-to-DC converter in electrical communication between a AC power source and an array of solid state light emitters.

In certain embodiments, a solid state lighting apparatus adapted to operate with alternating current (AC) received from an AC power source can include an array of solid state light emitters (e.g., LED chips) arranged on or over a substrate, with the array including a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle. In certain embodiments, at least one driver circuit component can be arranged on or over a first face of the substrate and arranged to drive the array of solid state light emitters, optionally adjacent one or more solid state emitters (e.g., LED chips) of the array. In certain embodiments, a reflective coating may be arranged over at least a portion of the at least one driver circuit component. In certain embodiments, the reflective coating may be arranged over an entirety of the at least one driver circuit component. In certain embodiments, a substrate may include a plurality of electrically conductive traces along at least one face of the substrate. In certain embodiments, at least one reflective structure may be diffusively reflective. In certain embodiments, at least one reflective structure may be specularly reflective. In certain embodiments, the at least one reflective structure may comprise at least one of a white color and a silver color. In certain embodiments, at least one reflective structure may comprise silicone that can be molded and at least partially cured. In certain embodiments, a reflective coating can be dispensed, painted, or sprayed over at least portions of (or optionally entirety of) the driver circuit component(s). In certain embodiments, the reflective coating can optionally comprise a wavelength conversion material such as one or more lumiphoric or phosphoric materials.

In certain embodiments, a solid state lighting apparatus adapted to operate with alternating current (AC) received from an AC power source can include an array of solid state light emitters (e.g., LED chips) arranged on or over a substrate that includes a first surface, a second surface opposing the first surface, electrical traces arranged on or over the first surface, and electrical traces arranged on or over the second surface. In certain embodiments, the array may include an array of solid state light emitters arranged on or over the first surface, the array comprising a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle. In certain embodiments, at least one driver circuit component may be arranged on or over the second surface and arranged to drive the array of solid state light emitters. In certain embodiments, the lighting apparatus may be devoid of any driver circuit component arranged on or over the first surface. By placing the solid state light emitters on or over a first surface of the substrate, and placing driver circuit component(s) on or over the second surface, absorption or blocking by the driver circuit component(s) of light emitted by the array may be reduced or eliminated. In certain embodiments, the lighting apparatus may be devoid of any AC-to-DC converter in electrical communication between the AC power source and the array of solid state light emitters.

In certain embodiments, a solid state lighting apparatus adapted to operate with alternating current (AC) received from an AC power source can include an array of solid state light emitters (e.g., LED chips) arranged on or supported by a substrate, with the array including a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle. In certain embodiments, a lighting device may include at least one surge protection component (optionally including multiple surge protection components) arranged on or over the substrate and adapted to reduce or eliminate transmission of voltage transients exceeding the line voltage to the array of solid state light emitters. In certain embodiments, at least two different solid state light emitter sets are each associated with a different surge protection component of the multiple surge protection components. In certain embodiments, at least one driver circuit component may be arranged on or over the substrate and arranged to drive the array of solid state light emitters. In certain embodiments, a lighting apparatus may be devoid of any AC-to-DC converter in electrical communication between the AC power source and the array of solid state light emitters.

In certain embodiments, a solid state lighting apparatus adapted to operate with alternating current (AC) received from an AC power source can include a first array of solid state light emitters (e.g., LED chips) including a first plurality of solid state light emitter sets each comprising multiple solid state light emitters arranged in or on a first elongated body structure, wherein at least two different solid state light emitter sets of the first plurality of individually controllable solid state light emitter sets are arranged to be activated and/or deactivated at different times relative to one another during a portion of an AC cycle; at least one driver circuit component arranged to drive the first array of solid state light emitters; and at least one electrical connector arranged to permit electrical communication between the first array of solid state light emitters and a second array of solid state light emitters that includes a second plurality of solid state light emitter sets each comprising multiple solid state light emitters arranged in or on a second elongated body structure. In certain embodiments, at least two different solid state light emitter sets of the second plurality of solid state light emitter segments may be arranged to be activated and/or deactivated at different times relative to one another during the portion of the AC cycle, with a first solid state light emitter set of the first array of solid state light emitters in electrical communication with a first solid state light emitter set of the second array of solid state light emitters, and with a second solid state light emitter set of the first array of solid state light emitters in electrical communication with a second solid state light emitter set of the second array of solid state light emitters. In certain embodiments, the first elongated body structure may include a first flexible body structure. In certain embodiments, the second elongated body structure may include a second flexible body structure. In certain embodiments, solid state lighting apparatuses as disclosed herein may include an AC cord and/or plug. In certain embodiments, a lighting apparatus may be devoid of any AC-to-DC converter in electrical communication between the AC power source and the array of solid state light emitters.

In certain embodiments, a solid state lighting apparatus adapted to operate with alternating current (AC) received from an AC power source can include an array of solid state light emitters arranged on or supported by a substrate, the array comprising a plurality of mutually exclusive solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; and at least one optical element comprising a lens and/or a diffuser arranged to receive emissions from each solid state light emitter of the array of solid state light emitters.

In certain embodiments a lighting apparatus adapted to operate with alternating current (AC) received from an AC power source can include a base end, a light-transmissive end opposing the base end, and an array of solid state light emitters including a plurality of solid state light emitter sets each comprising multiple solid state light emitters, wherein at least two different solid state light emitter sets of the plurality of individually controllable solid state light emitter segments are arranged to be activated and/or deactivated at different times relative to one another during a portion of an AC cycle. In certain embodiments, a reflector including a cavity and a reflective surface may be arranged to permit transmission of light reflected by the reflector toward the light-transmissive end and an array of solid state emitters can be arranged in or above the cavity to transmit emissions of the solid state emitters toward the reflective surface. In certain embodiments, the array of solid state emitters can be arranged to emit light in a direction toward the base end to impinge on the reflective surface for reflection of light toward the light-transmissive end. In certain embodiments, light emissions transmitted through the light-transmissive end may comprise emissions reflected by the reflective surface and may be devoid of direct emissions from the array of solid state emitters. In certain embodiments, the reflector may include a cup-shaped body that defines the cavity. In certain embodiments, the reflective surface is diffusively reflector or is specularly reflective. In certain embodiments, a lighting apparatus is devoid of any AC-to-DC converter in electrical communication between the AC power source and the array of solid state light emitters.

In certain embodiments, each set of solid state light emitters comprises at least one electrostatic discharge protection element in electrical communication therewith.

In certain embodiments, each set of solid state light emitters comprises at least one surge protection element or component in electrical communication therewith.

In certain embodiments, each set of solid state light emitters comprises at a plurality of surge protection elements or components in electrical communication therewith. At least two sets can be in electrical communication with at least two different surge protector elements or components.

In certain embodiments, solid state light emitters comprising a larger duty cycle may be positioned close to solid state emitters comprising a smaller duty cycle (e.g., with emitters comprising the largest duty cycle positioned closer to emitters comprising the smallest duty cycle than to any other emitters of a lighting device), such as may be beneficial to avoid perceptible spatial variations in light intensity and/or color, and/or may be beneficial for managing heat dissipation from a lighting device. In certain embodiments, a set of solid state light emitters having a smallest duty cycle of multiple sets of solid state light emitters is disposed proximate to a center of a substrate on or over which multiple sets of solid state emitters are arranged.

In one embodiments, a solid state lighting apparatus adapted to operate with AC power received from an AC power source may include: multiple sets of one or more solid state light emitters arranged on or supported by a substrate, wherein at least first and second sets of the multiple sets of solid state light emitters are configured to be activated and/or deactivated at different times relative to one another during a portion of an AC cycle, and wherein the first and second sets of the multiple sets of solid state light emitters comprise different duty cycles; and wherein at least one solid state light emitter of the first set of solid state light emitters comprises a largest duty cycle of the different duty cycles and is arranged closer in proximity to at least one solid state emitter of the second solid state light emitter set comprising a smallest duty cycle of the different duty cycles than in proximity to any other solid state light emitter of the multiple sets of solid state light emitters. In certain embodiments, the multiple sets of solid state light emitters may include at least three different sets of solid state light emitters adapted to be activated and/or deactivated at different times relative to one another.

In certain embodiments, multiple sets of solid state light emitters that are configured to be activated and/or deactivated at different times relative to one another during a portion of an AC cycle are configured to operate preferably within 15 percent, more preferably within 10 percent, more preferably within 5 percent, and more preferably within 3 percent, of a root mean square (RMS) voltage of the AC power source. In certain embodiments, the AC power source has frequency of 16.7 Hz, 50 Hz, 60 Hz, or 400 Hz, or any intermediate value between two or more of the foregoing frequency values. In certain embodiments, the AC cycle comprises a substantially sinusoidal waveform cycling between positive and negative voltages. In certain embodiments, the AC power source has a nominal RMS voltage of at least about 100V, such as including approximate values of 40V, 90V, 110V, 120V, 170V, 220V, 230V, 240V, 277V, 300V, 480V, 600V higher voltages, or any approximate or subset of voltage as previously recited. Operation of solid state light emitters at elevated voltages contradicts the traditional practice of converting power received from an AC source to substantially lower voltage DC power using an AC/DC converter in order to power solid state emitters (e.g., LED chips).

In certain embodiments, an AC voltage signal supplied to a lighting apparatus as described herein may include single phase AC voltage signal. In other embodiments the AC voltage signal may be obtained from multiple leads of a three phase AC voltage signal. Accordingly, the AC voltage signal can be provided from higher voltage AC voltage signals, regardless of the phase type. For example, in some embodiments of the present subject matter, the AC voltage signal can be provided from a three phase 600 VAC signal. In still further embodiments of the present subject matter, the AC voltage signal can be a relatively low voltage signal, such as approximately 12 VAC.

In certain embodiments, a lighting apparatus as described herein receives an AC input signal from an AC power source via an AC power cord and/or AC plug arranged to plug into a conventional wall receptacle, with one end of the power cord comprising a two- or three-conductor male plug, and the other end of the power cord terminating in or on the lighting apparatus.

In certain embodiments, a lighting apparatus as described herein is devoid of any AC-to-DC converter in electrical communication between the AC power source and multiple sets (e.g., disposed in an array) of solid state light emitters. In certain embodiments, a lighting apparatus as described herein comprises at least one current diversion circuit (or multiple current diversion circuits in certain embodiments) arranged in electrical communication between an AC source and multiple sets of solid state light emitters. In certain embodiments, a lighting apparatus as described herein comprises at least one current limiting circuit (or multiple current limiting circuits in certain embodiments) arranged in electrical communication between an AC source and multiple sets of solid state light emitters. In certain embodiments, a lighting apparatus as described herein comprises at least one driving circuit (or multiple driving circuits in certain embodiments) arranged in electrical communication between an AC source and multiple sets of solid state light emitters. In certain embodiments, a lighting apparatus as described herein comprises at least one rectifier bridge (or multiple rectifier bridges in certain embodiments) arranged in electrical communication between an AC source and multiple sets of solid state light emitters.

In certain embodiments, a lighting apparatus as described herein includes multiple sets of solid state light emitters that are configured to be activated and/or deactivated at different times relative to one another during a portion of an AC cycle, and each set of the multiple sets comprises at least a first solid state light emitter of a first color and at least a second solid state light emitter of a second color that is different than the first color. In certain embodiments, each set of the multiple sets comprises at least two solid state light emitters of a first color. In certain embodiments, each set of the multiple sets of solid state emitters is adapted to emit one or more of the same color(s) of light (e.g., to emit one or more peak wavelengths that coincide among multiple sets of emitters). In certain embodiments, each set of the multiple sets of solid state emitters is adapted to emit one or more color(s) of light that differ relative to one another (e.g., with each set of solid state emitters emitting at least one peak wavelength that is not emitted by another set of solid state emitters).

In certain embodiments, a lighting apparatus as described herein includes multiple sets of solid state light emitters that are configured to be activated and/or deactivated at different times relative to one another during a portion of an AC cycle, and the lighting apparatus comprises an output of preferably at least about 70 lumens per watt (LPW), more preferably at least about 80 LPW, more preferably at least about 90 LPW, and still more preferably at least about 100 LPW. Preferably, one or more of the foregoing LPW thresholds are attained for emissions having at least one of a cool white color temperature and a warm white color temperature. Preferably, white emissions have x, y color coordinates within four MacAdam step ellipses of a reference point on the blackbody locus of a 1931 CIE Chromaticity Diagram. In certain embodiments, such a reference point on the blackbody locus may have a color temperature of preferably less than or equal to 5000 K, more preferably less than or equal to 4000 K, more preferably less than or equal to 3500 K, or more preferably less than or equal to 3000 K. In certain embodiments, combined emissions from a lighting apparatus as described herein embody at least one of (a) a color rendering index (CRI Ra) value of at least 85, and (b) a color quality scale (CQS) value of at least 85.

In certain embodiments, a lighting apparatus as described herein includes an array of solid state light emitters arranged on or supported by a substrate, with the array including a plurality of solid state light emitter sets each comprising multiple solid state emitters, wherein multiple sets of solid state light emitters are configured to be activated and/or deactivated at different times relative to one another during a portion of an AC cycle, and within the array, at least one solid state light emitter of a first solid state light emitter set is arranged closer to at least one solid state emitter of a second solid state light emitter set than to any other solid state light emitter of the first solid state light emitter set. Such placement may be beneficial to avoid or reduce perceptible spatial variations in light intensity and/or color, and/or may be beneficial for managing heat dissipation from a lighting device. In certain embodiments, the multiple sets of solid state light emitters include at least two sets having different duty cycles (e.g., including a largest duty cycle and a smallest duty cycle). In certain embodiments, at least a majority of solid state light emitters comprising the smallest duty cycle are arranged in a central region of a substrate, and at least a majority of solid state light emitters comprising the largest duty cycle are arranged in a peripheral region of the substrate.

In certain embodiments, a lighting apparatus as described herein includes multiple sets of solid state light emitters that are configured to be activated and/or deactivated at different times relative to one another during a portion of an AC cycle, wherein, for a majority of solid state light emitters of a first solid state emitter set, each solid state light emitter of the majority of solid state light emitters is arranged closer to at least one solid state emitter of a second solid state light emitter set than to any other solid state light emitter of the first solid state light emitter set.

In certain embodiments, a first solid state light emitter set of the at least two different solid state emitter sets may comprise a smallest duty cycle of the different duty cycles, a second solid state light emitter set of the at least two different solid state emitter sets may comprise a largest duty cycle of the different duty cycles, at least a majority of solid state emitters of the first solid state light emitter set may be disposed in the central portion of the substrate, and at least a majority of solid state emitters of the second solid state light emitter set may be disposed in the peripheral portion of substrate. In certain embodiments, a central portion of a substrate of a solid state lighting apparatus may contain solid state emitters having a greater aggregated light emission area than a peripheral portion of the substrate. In certain embodiments, a plurality of solid state light emitter sets may comprise at least three different solid state light emitter sets arranged to be activated and/or deactivated at different times relative to one another. In certain embodiments, multiple solid state light emitters of an array of solid state light emitters including multiple emitter sets arranged to receive power from an AC source may be symmetrically arranged within or along a region of a substrate supporting the array. In certain embodiments, for each solid state light emitter set, multiple solid state light emitters may be arranged with azimuthal or rotational symmetry within or along the region. In certain embodiments, for each solid state light emitter set, the multiple solid state light emitters may be arranged with lateral symmetry within or along the region.

In certain embodiments, at least two different solid state emitter sets comprise different duty cycles relative to one another, or at least three different solid state light emitter sets arranged to be activated and/or deactivated at different times relative to one another.

In certain embodiments, a first solid state light emitter set includes a plurality of LED chips adapted to generate peak emissions in a blue range and arranged to stimulate at least one phosphor adapted to generate peak emissions in a yellow range or a green range, and a second solid state light emitter set includes a plurality of LED chips adapted to generate peak emissions in an orange range or a red range.

In certain embodiments, color temperature of aggregated emissions of a lighting apparatus adapted to operate with AC received from an AC power source may be adjusted by adjusting duty cycle of one or more sets of multiple sets of solid state emitters that are each separately arranged to emit white light but at different color temperatures. In certain embodiments, beam patterns output from a solid state lighting device may be adjusted by adjusting duty cycles of different solid state light emitter sets, preferably without use of any mechanical elements. In certain embodiments, different sets of solid state light emitters are arranged differently with respect to at least one reflector and/or at least one optical element to permit such beam pattern adjustment.

In certain embodiments, a lighting apparatus includes an array of solid state light emitters arranged on or supported by a body structure and including a plurality of solid state light emitter sets each comprising multiple solid state light emitters, wherein at least two different solid state light emitter sets of the plurality of solid state light emitter sets are arranged to be activated and/or deactivated at different times relative to one another during a portion of an AC cycle; at least one reflector and/or at least one optical element arranged to receive emissions from the plurality of solid state light emitter sets, and arranged to affect a beam pattern generated by the lighting device; and a control element arranged to permit adjustment of duty cycle of each solid state light emitter set of the at least two solid state light emitter sets, and thereby permit adjustment of said beam pattern. In certain embodiments, both at least one reflector and at least one optical element may be provided. In certain embodiments, a first reflector or first reflector portion may be arranged to receive emissions from a first solid state light emitter set of the plurality of solid state light emitter sets, and a second reflector or second reflector portion may be arranged to receive emissions from a second solid state light emitter set of the plurality of solid state light emitter sets. In certain embodiments, a first optical element portion may be arranged to receive emissions from a first solid state light emitter set, and a second optical element portion may be arranged to receive emissions from a second solid state light emitter set.

Various illustrative features are described below in connection with the accompanying figures.

FIG. 1 is a schematic block diagram illustrating a solid state lighting apparatus generally designated 10 according to some embodiments of the present subject matter. According to FIG. 1, the solid state lighting apparatus 10 can include a light emitting diode (LED) driver circuit 12 coupled to an LED string circuit 14, both of which can be mounted, arranged, and/or sported on a surface of a substrate 16. The term "mounted on" as used herein includes configurations where the component, such as an LED chip or submount of a LED package, can be physically and/or electrically connected to a portion of substrate 16 via solder, epoxy, silicone, adhesive, glue, paste, combinations thereof and/or any other suitable attachment material and/or method. Accordingly, different components that are described as being "mounted on" a substrate can be disposed on the same surface of a substrate, or on opposing surfaces of the same substrate. For example, components that are placed and soldered on the same substrate during assembly can be described as being "mounted on" that substrate.

LED driver circuit 12 can be coupled to an alternating electrical AC voltage power source, which can provide an alternating electrical signal (current and voltage) to at least one LED string circuit 14, and other circuits included in solid state lighting apparatus 10, to cause light to be emitted from solid state lighting apparatus 10. The at least one LED string circuit 14 can comprise multiple solid state light emitters, such as LED chips, preferably arranged as multiple groups of sets of LED chips, where each group or set is preferably separately controllable relative to each other group or set. In some aspects, LED string circuit 14 can comprise a multi-dimensional (e.g., two-dimensional) array of LED chips. The LED chips can be optionally arranged in one or more mutually exclusive groups, segments, or sets of LED chips. In one aspect, LED string circuit 14 comprises an array of LED chips arranged in mutually exclusive sets of one or more (preferably multiple) LED chips.

It will be appreciated that various embodiments described herein can make use of the direct application of AC voltage to apparatus 10 (e.g., from an outside power source, not shown) without the inclusion of an "on-board" switched mode power supply. That is, various embodiments relate to devices that are devoid of any AC-to-DC converter in electrical communication between the AC power source (not shown) and the multiple groups of LED chips. In certain embodiments, LED driver circuit 12 can output current including a rectified AC waveform to LED string circuit 14 to generate acceptable light output from apparatus 10. It can further be appreciated that solid state lighting apparatus 10 can be utilized in light bulbs, lighting devices, and/or lighting fixtures of any suitable type, such as, for example and without limitation, the various lighting devices illustrated in FIGS. 9A and 9B.

Figure 3:
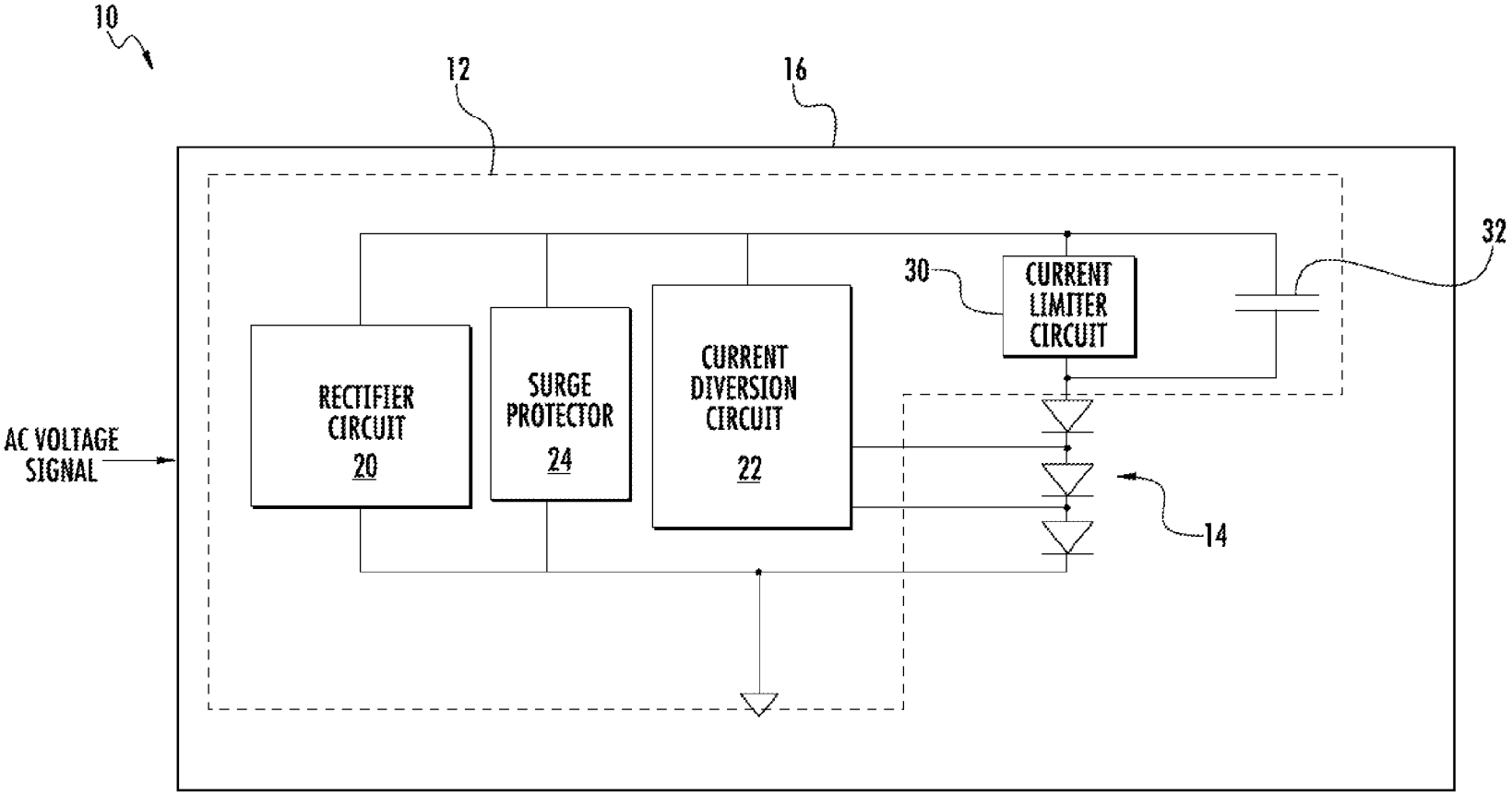
FIG. 3 is a schematic block diagram illustrating the LED driver circuit shown in FIGS. 1 and 2 further including a current limiter circuit and a capacitor coupled to the LED string circuit according to certain embodiments.

In certain embodiments, LED driver circuit 12 can include one or more of the following: components used to rectify the AC voltage signal, components to provide an electrical current source to at least one LED string circuit 14, components for at least one current diversion circuit, components for at least one current limiting circuit (e.g., to limit the amount of current passing through at least one LED chip and/or set of LED chips in LED string circuit 14), and at least one energy storage device, such as a capacitor 32 (such as shown in FIG. 3). In certain embodiments one or more of the foregoing components can be mounted or disposed on a portion of substrate 16 as discrete elements. In further embodiments, some or all of the foregoing circuit elements described herein can be integrated into one or more integrated circuits or circuit packages mounted or disposed on a portion of substrate 16.

LED string circuit 14 can include a plurality of "chip-on-board" (COB) LED chips and/or packaged LED chips that can be electrically coupled or connected in series or parallel with one another and mounted on a portion of substrate 16. In certain embodiments, COB LED chips can be mounted directly on portions of substrate 16 without the need for additional packaging. In certain embodiments, LED string circuit 14 can make use of packaged LED chips in place of the COB LED chips. For example, in certain embodiments LED string circuit 14 can comprise serial or parallel arrangements of XLamp XM-L High-Voltage (HV) LED packages available from Cree, Inc. of Durham N.C.

In certain embodiments, a solid state lighting apparatus 10 can comprise a relatively small form factor board or substrate 16, which can be directly coupled to an AC voltage signal and can provide a rectified AC voltage signal to string circuit 14 without the use of an on-board switched mode power supply. COB LED chips and/or LED packages within circuit 14 can be electrically connected in serial arrangements, parallel arrangements, or combinations thereof.

In certain embodiments, substrate 16 can be provided in any relatively small form factor (e.g., square, round, non-square, non-round, symmetrical and/or asymmetrical) such as those described herein in reference to FIGS. 6A to 6E. Further, the resulting small board with COB LED chips or LED packages included thereon operated by the direct application of AC voltage signal (i.e., without an on-board switched mode power supply) can provide a small and efficient output lighting apparatus 10 that can deliver approximately 70 lumens per Watt (LPW) or more in select color temperatures, such as cool white or warm white color temperatures (e.g., from approximately 2700 to 7000 K).

In other embodiments, a substrate 16 may comprise a larger form factor, such as may be suitable for replacement of elongated fluorescent tube-type bulbs or replacement of fluorescent light fixtures.

Figure 2:
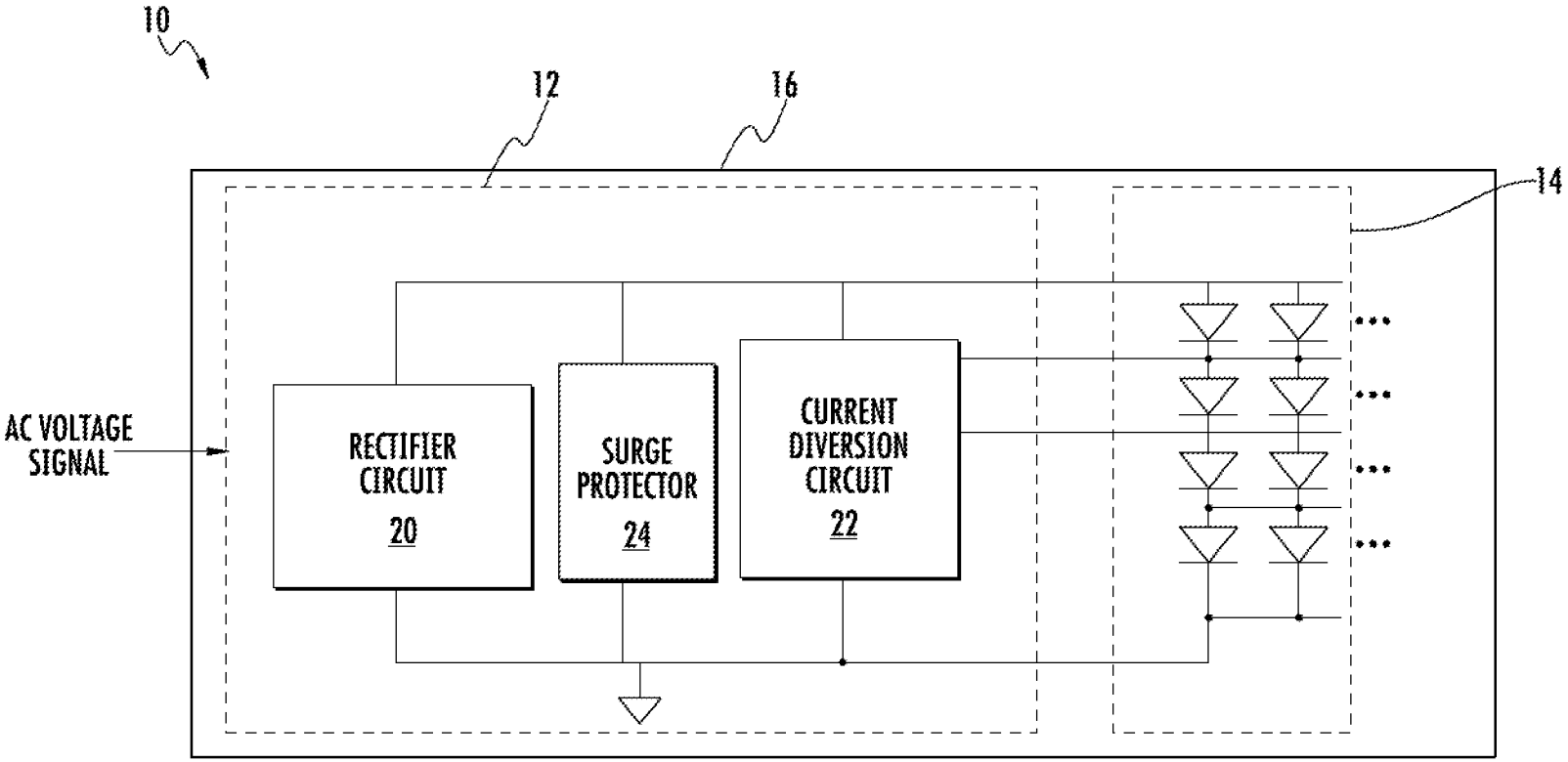
FIG. 2 is a schematic block diagram illustrating the LED driver circuit including a rectifier circuit and a current diversion circuit as shown in FIG. 1 and a LED string circuit coupled thereto according to certain embodiments.

FIG. 2 is a schematic block diagram illustrating solid state lighting apparatus 10 as shown in FIG. 1 as applied to certain embodiments. According to FIG. 2, LED driver circuit 12 can include a rectifier circuit 20 coupled to a current diversion circuit 22, a surge protector 24 or surge protection circuit, and LED string circuit 14. LED string circuit 14 can comprise at least one plurality of LED chips and/or LED packages coupled in series and more preferably multiple sets of multiple LED chips and/or LED packages. Each component within LED driver circuit 12 (e.g., components of rectifier circuit 20, current diversion circuit 22, and surge protector 24) can be disposed or attached over portions of substrate 16 and can be supported by the same and/or different sides or surfaces of substrate 16. As further shown in FIG. 2, current diversion circuit 22 can be coupled to selected nodes between one or more sets of LED chips and/or LED packages in string circuit 14. Notably, as described further below with respect to FIGS. 8A to 8G, one or more components of LED driver circuit 12 can be at least partially coated with a reflective coating and/or be disposed below or within a portion of a reflective structure for reducing or eliminating impingement of light generated by LED chips or packages within LED string circuit 14 on components within driver circuit 12.

Current diversion circuit 22 can be configured to operate responsive to a bias state transition of those sets of respective LED chips or LED packages across which current diversion circuit 22 is coupled. In some aspects, LED chips or packages within string circuit 14 can be incrementally activated and deactivated responsive to the forward biasing of LED sets as a rectified AC voltage is applied to LED string circuit 14. For example, current diversion circuit 22 can include transistors configured to provide respective controllable current diversion paths around certain LED sets disposed between the selected nodes to which current diversion circuit 22 is coupled. Such transistors can be turned on or off by the biasing transitions of LED sets which can be used to affect the biasing of the transistors. Current diversion circuits 22 operating in conjunction with an LED string circuit 14 are further described, for example, in commonly assigned co-pending U.S. application Ser. No. 13/235,127, the entirety of which is incorporated by reference herein. Current diversion circuit 22 can activate and/or deactivate different LED sets at different times relative to one another during a portion of an AC cycle as explained further below. In certain embodiments, and as explained below, solid state lighting apparatus 10 can comprise multiple LED sets having different duty cycles. In various embodiments, the multiple LED sets can be provided and strategically positioned over portions of substrate 16 to reduce perceived flicker, perceived color shifts, and/or perceived (e.g., positional or directional) flux variation during activation and/or deactivation of the respective LED chips. As further described below, in certain embodiments, one or more reflective structures can also be mounted, arranged, or supported by portions of substrate 16 for improving light intensity and/or eliminating obstruction of light via drive circuitry elements or components, such as components of LED driver circuit 12.

In certain embodiments, surge protector 24 can comprise any suitable surge protection device or surge protection circuit adapted to protect LED chips from voltage spikes. Notably, surge protector 24 can be built in to portions of apparatus 10 such that surge protector 24 can be disposed on and in some aspects directly supported and attached to portions of substrate 16. Surge protector 24 can comprise at least one of a metal oxide varistor (MOV), a transient voltage suppression diode, a Zener diode, an avalanche diode, a silicone avalanche diode (SAD), a thyristor surge protection device, or any other suitable device known for protecting LED chips from voltage spikes.

As further shown in FIG. 2, in certain embodiments, rectifier circuit 20, current diversion circuit 22, surge protector 24, and LED string circuit 14 can be mounted or disposed on a portion of substrate 16 such that each of these components is provided on a single surface of the substrate 16. In certain embodiments, some of the circuits described herein are mounted on a first side of the substrate 16 whereas the remaining circuits are mounted on an opposing side of substrate 16 (see e.g., FIG. 8E). In certain aspects, the circuits described herein can be mounted directly on the substrate 16 without the use of intervening substrates, submounts, carriers, or other types of surfaces which are sometimes used to provide stacked types of assemblies in conventional arrangements.

In certain embodiments, some or all of the components described in reference to FIG. 2 can be mounted on the substrate 16 as discrete electronic component packages. In certain embodiments, some of the remaining circuits described in reference to FIG. 2 can be integrated into a single integrated circuit package mounted on the substrate 16. Portions of the discrete electronic component packages and/or integrated circuit package can be optionally coated with a reflective coating and/or disposed below, adjacent, and/or proximate one or more reflective structures for decreasing or eliminating an amount of light absorbed thereby or for decreasing or eliminating an amount of light impinged upon the discreet component packages or integrated circuit package.

In certain embodiments, solid state lighting apparatus 10 may include one or more current diversion circuits 22 coupled to portions of string circuit 14 alone without use of surge protector 24 and without use of a current limiter circuit 30 (FIG. 3) and capacitor 32 (FIG. 3). That is, in certain embodiments, current diversion circuit 22 can be used alone to selectively activate and/or deactivate sets of LED chips and/or packages within circuit 14 without the need for current limiter circuit 30 and/or capacitor. However, as current limiter circuit 30 can be configured to supply current to capacitor 32 instead of LED chips within circuit 14, in certain embodiments, current and/or energy can advantageously be stored within capacitor 32 and/or configured to discharge charge from capacitor 32 through LED string circuit 14 during portions of the rectified AC waveform in order to reduce or eliminate perceived flicker and/or observable color change during activation and/or deactivation of one or more LED sets.

In certain embodiments, apparatuses 10 as described herein can provide at least about 700 lumens (lm), or provide about 700 lm to about 820 lm, an efficacy ranging from between about 71 LPW and about 80 LPW at cool white or warm white color temperatures. It will be understood that in certain embodiments, however, that greater output may be achieved by, for example, increasing the number of LED chips and/or packages or by increasing the current signal or level used to drive the LED chips or packages. A greater output may also be achieved by, for example, incorporating reflective structures, reflective coatings, optical diffusers, remote phosphors, or wavelength conversion material (e.g., phosphor(s), lumiphors(s), etc.) over portions of each apparatus as described further below.

Figure 4:
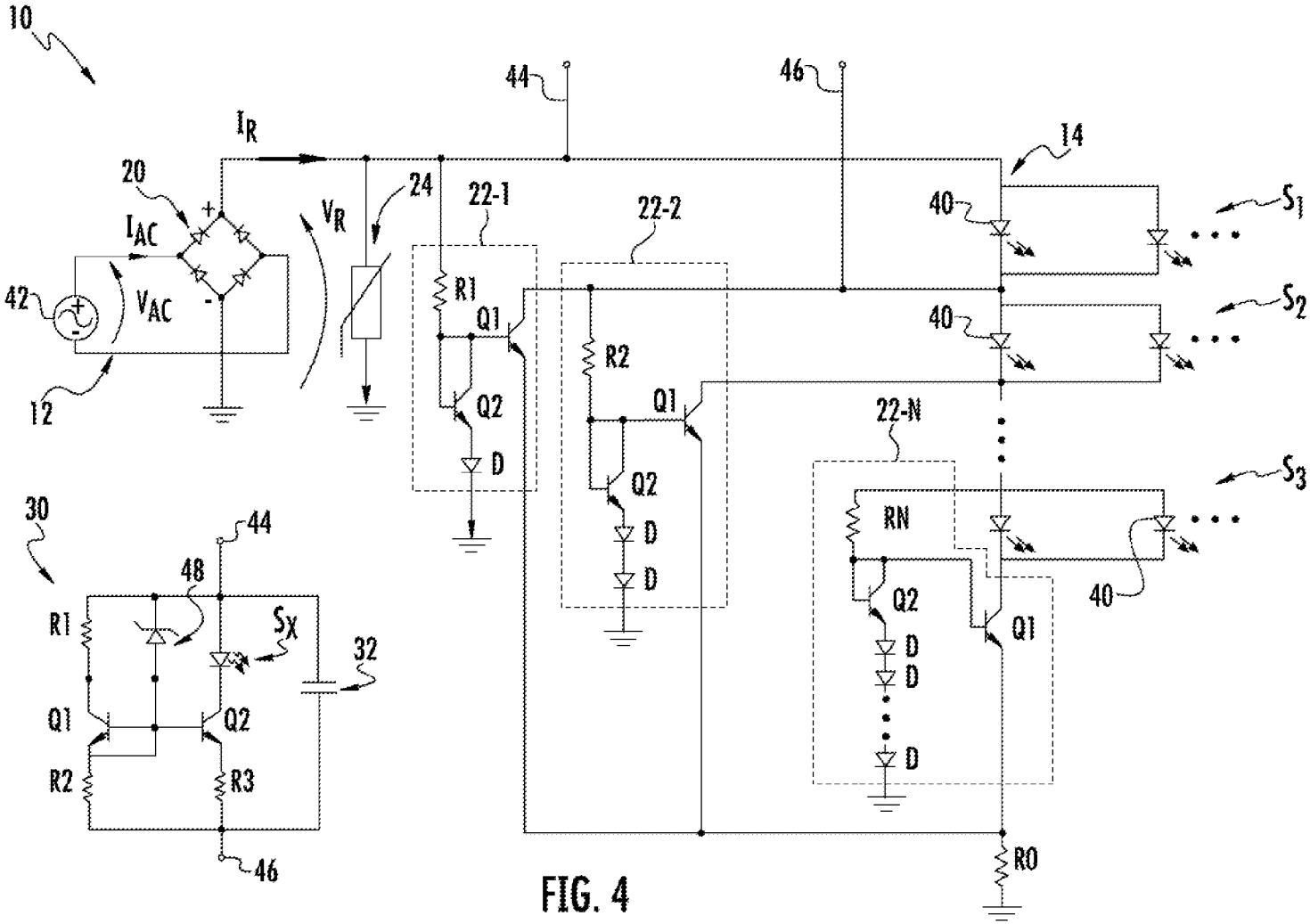
FIG. 4 is a circuit schematic diagram illustrating an LED driver circuit coupled to an LED string circuit according to certain embodiments.

FIG. 3 is a schematic block diagram illustrating solid state lighting apparatus 10 including LED driver circuit 12 according to certain embodiments. LED driver circuit 12 may include a rectifier circuit 20, one or more current diversion circuits 22-1, 22-2, . . . , 22-N (as shown in FIG. 4), and/or at least one surge protector 24 connected to respective LED sets or strings within LED string circuit 14. In certain embodiments, driver circuit 12 can be coupled to current limiter circuit 30 which can be connected in parallel to a capacitor 32, both of which are optional and can be coupled in series with LED string circuit 14. In certain embodiments, driver circuit 12, rectifier circuit 20, current diversion circuit 22, string circuit 14, and current limiter circuit 30 can all be mounted on one or more portions of the same and/or different surfaces of substrate 16.

It will be understood that current limiter circuit 30 and capacitor 32 according to certain embodiments can advantageously reduce flicker which may otherwise result from the AC voltage provided directly to solid state light emitters of solid state lighting apparatus 10. For example, capacitor 32 can be used to store energy (e.g., near peak voltage) and use that stored energy to drive portions of LED string 14 (e.g., one or more LED sets) when the AC voltage magnitude is less than what may be required to forward bias the LED chips or packages in string circuit 14. Still further, current limiter circuit 30 can be configured to direct current to capacitor 32 so that energy is stored therein or configured to discharge the charge in capacitor 32 through LED string circuit 14. Although FIG. 3 shows a capacitor 32 as being used to store and deliver energy, it is also understood that in certain embodiments any type of electronic energy storage device (e.g., including but not limited to inductors) can be used as an alternative to or, in combination with, capacitor 32.

In certain embodiments, the components shown in FIG. 3 can be mounted on the same surface of the substrate 16 and/or one or more different surfaces of substrate 16. For example, in certain embodiments, some circuits shown in FIG. 3 can be mounted on a first surface of substrate 16 whereas the remaining circuits can be mounted on a second, opposing surface of substrate 16. In certain embodiments, LED chips included in the LED string circuit 14 may include COB LED chips that may be mounted on any surface of substrate 16 or on a submount or other substrate which is coupled to the substrate 16, for example, a submount of an LED package. Components of solid state lighting apparatus 10 can be mounted on any surface and/or any combination of different surfaces.

In certain embodiments, all solid state emitters (e.g., LED chips) are mounted on or over a first surface (e.g., first face) of a substrate that preferably includes electrical traces, and at least some (more preferably all) driver components are mounted on or over (or "under" depending on relative orientation of the lighting apparatus) a second surface of the substrate that preferably includes electrical traces. Electrical communication between solid state emitters and driver components may be established through the substrate using conductive vias, edge traces, edge connectors, or other conductive elements.

Figure 5A:
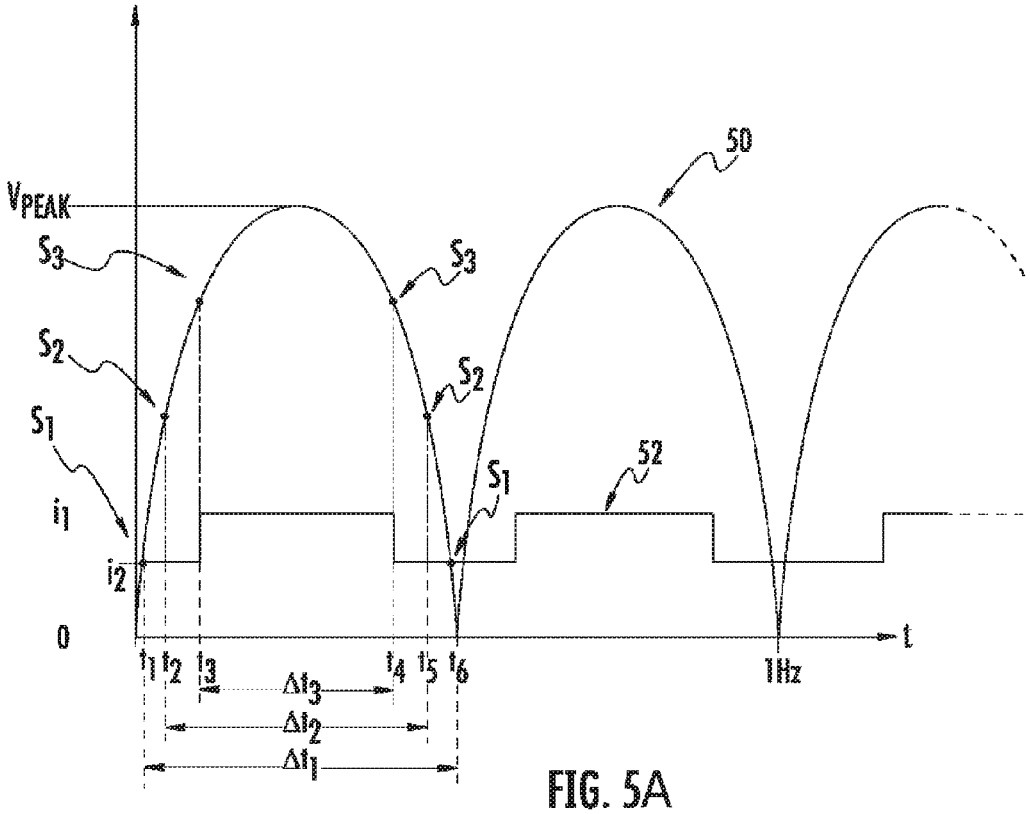
FIG. 5A is a plot of voltage versus time of a rectified AC waveform with a superimposed plot of activation and deactivation times for three LED sets and a superimposed plot of average current with respect to time of a solid state lighting apparatus according to certain embodiments.

FIG. 4 is a circuit schematic diagram of solid state lighting apparatus 10 according to certain embodiments. FIG. 4 illustrates LED driver circuit 12 coupled to LED string circuit 14. In certain embodiments, string 14 can comprise one or more strings of serially connected sets of solid state emitters, such as one or more sets of LED chips (which can be packaged LED chips or COB) generally designated $S_1, S_2, \ldots, S_N$. In certain embodiments, each LED set $S_1, S_2, \ldots, S_N$ can be mutually exclusive and can comprise at least one packaged or non-packaged LED chip 40. In certain embodiments, at least two different LED sets of the plurality of LED sets $S_1, S_2, \ldots, S_N$ are configured to be activated and/or deactivated at different times relevant to one another during a portion of an AC waveform, such as shown in FIG. 5A.

In certain embodiments, each set $S_1, S_2, \ldots, S_N$ can also include more than one packaged or non-packaged LED chip 40. Where multiple LED chips 40 are used, chips 40 within a given set $S_1, S_2, \ldots, S_N$ can be arranged in series, parallel, and/or combinations thereof. In certain embodiments, each LED set $S_1, S_2, \ldots, S_N$ can be configured to be activated and/or deactivated at different times. In certain embodiments, LED sets $S_1, S_2, \ldots, S_N$ can be sequentially activated and deactivated in the reverse order. Notably, LED sets $S_1, S_2, \ldots, S_N$ can be strategically arranged on portion of substrate 16 such that color and light output from apparatus 10 can be consistently maintained (e.g., with no perceived flicker, perceived color shift, and/or perceived positional or directional flux variation) during activation and/or deactivation of different LED sets $S_1, S_2, \ldots, S_N$ at different times. In certain embodiments, each LED set $S_1, S_2, \ldots, S_N$ can comprise a plurality of LED chips optionally arranged in one or more arrays comprised of serial and/or parallel arrangements.

In certain embodiments, each LED set $S_1, S_2, \ldots, S_N$ can be disposed below, adjacent to, and/or proximate to one or more reflective structures, such as one or more of the following: a lens, a dam, a damlet, a reflective wall, a cup-shaped reflector, a diffuser, a lens having remote phosphor, any optical element, combinations thereof, etc., for improving or maximizing light intensity and/or light extraction from solid state lighting apparatus 10. In certain embodiments, reflective structures may include portions of reflective coatings or structures as described further below with respect to FIGS. 8A to 8G.

In certain embodiments, LED chips 40 of each LED set $S_1, S_2, \ldots, S_N$ can comprise one or more chips of the same color (e.g., $S_1, S_2, \ldots, S_N$ can be the same color) or different colors (e.g., $S_1, S_2, \ldots, S_N$ can each be a different color). In certain embodiments, one or more LED sets $S_1, S_2, \ldots, S_N$ can comprise differently colored LED chips 40 within that set (e.g., intra-set). In certain embodiments, each LED set $S_1, S_2, \ldots, S_N$ can comprise the same color combination as other sets (e.g., $S_1, S_2, \ldots, S_N$ can each have a blue, red, and green chip) or at least one set can have a color combination that differs from at least one other set (e.g., $S_1$ can have a blue, red, and green chip and $S_2$ can have a blue shifted yellow (BSY), cyan, and amber chip). In certain embodiments, multiple LED chips 40 having the same and/or any different combinations of color, wavelength, color temperature, and/or brightness may be provided in one or more sets.

In certain embodiments, any combination and/or variation of one or more color of LED chips intra-set and/or inter-set are contemplated herein, whether provided as combinations of LED chips and/or LED chips in combination with differently colored lumiphors (e.g., phosphors). Certain embodiments may utilize LED chips that can individually be adapted to generate peak emissions and/or a peak wavelength in a blue range, a cyan range a green range, a red range, red-orange, orange, amber, and/or in a yellow range light upon activation by electrical current. In certain embodiments. LED chips can be used alone or in combination with one or more lumiphors (e.g., phosphors) configured to generate peak emissions in a red range, an orange range, a cyan range, a green range, a blue range, a yellow range, or any other desired color range upon activation or stimulation by light from one or more LED chips. At least one LED set can be adapted to emit at least one peak wavelength that differs by at least 30 nm from at least one peak wavelength emitted by at least one other LED chip in at least one other LED set. In further embodiments, at least one LED set can be adapted to emit a first peak wavelength and to emit a second peak wavelength that differs from the first peak wavelength by at least 30 nm. Notably, driver circuit 12 can be configured to activate and/or deactivate different sets of LED chips without a perceptible shift in color point, color temperature, and/or without perceptible flicker. In part, this can be accomplished by intra-set and inter-set color selection, and/or by relative positioning of LED sets and/or their constituent LED chips.

As illustrated in FIG. 4, in certain embodiments each mutually exclusive LED set $S_1, S_2, \ldots S_N$ can comprise more than one LED chip 40, where each LED chip 40 in the set is connected in parallel. Each LED set $S_1, S_2, \ldots, S_N$ can then be serially connected. However, in other embodiments, any other serial and/or parallel arrangement of LED chips may be provided. For example, parallel connected sets $S_1, S_2, \ldots, S_N$ and/or sets having serially connected and/or serial and parallel connected LED chips 40 may be provided. As noted earlier, each LED chip 40 can be, but does not have to be packaged. The sets of LED chips 40 may be configured in a number of different ways and may have various compensation circuits associated therewith, as discussed, for example, in commonly assigned co-pending U.S. application Ser. Nos. 13/235,103 and 13/235,127, the entire disclosures of which are incorporated herein by reference.

In certain embodiments, electrical power or signal can be provided to LED string 14 by driver circuit 20 comprising rectifier circuit 20 that is configured to be coupled to an AC power source 42 and to produce a rectified voltage $V_R$ and current $I_R$ therefrom. In certain embodiments, rectifier circuit 20 can comprise four diodes which prevent current from flowing in the negative direction, thereby producing a rectified AC waveform (e.g., 50, FIG. 5). Any other suitable circuits for producing rectified AC waveforms are contemplated herein. In certain embodiments, driver circuit 20 may be included in lighting apparatus 10 or may be part of a separate unit that is coupled to apparatus 10.

In certain embodiments, apparatus 10 may include respective current diversion circuits 22-1, 22-2, . . . , 22-N connected to respective nodes and/or LED sets $S_1, S_2, \ldots S_N$ of string circuit 14. Current diversion circuits 22-1, 22-2, . . . , 22-N can be configured to provide current paths that bypass respective LED sets $S_1, S_2, \ldots, S_N$. The current diversion circuits 22-1, 22-2 . . . , 22-N can each include at least one transistor Q1 configured to provide a controlled current path that may be used to selectively bypass one or more LED sets $S_1, S_2, \ldots, S_N$. Transistors Q1 can be biased using one or more second transistors Q2, one or more resistors R1, R2, . . . , RN and/or one or more diodes D. Second transistors Q2 can be configured to operate as diodes, with base and collector terminals connected to one another. Differing numbers of diodes D can be connected in series with second transistors Q2 in respective ones of current diversion circuits 22-1, 22-2, . . . , 22-N, such that the base terminals of current path transistors Q1 in the respective current diversion circuits 22-1, 22-2, . . . , 22-N can be biased at different voltage levels. Resistors R1, R2, . . . , RN can limit base currents for current path transistors Q1. Current path transistors Q1 of the respective current diversion circuits 22-1, 22-2, . . . , 22-N can turn off at different emitter bias voltages, which can be determined by a current flowing through apparatus resistor R0. Accordingly, current diversion circuits 22-1, 22-2, . . . , 22-N can be configured to operate in response to bias state transitions of the LED sets $S_1, S_2, \ldots, S_N$ as the rectified voltage $V_R$ increases and decreases such that the LED sets $S_1, S_2, \ldots, S_N$ can be incrementally and selectively activated and deactivated as the rectified voltage VR rises and falls. Current path transistors Q1 can be turned on and off as bias states of LED sets $S_1, S_2, \ldots, S_N$ change.

In certain embodiments, string circuit 14, including serially connected LED sets $S_1, S_2, \ldots, S_N$, can also be connected to surge protection device 24 and coupled in series with current limiter circuit 30. For illustration purposes, surge protection device 24 is shown as including an MOV, however, any suitable device, devices, component, or components can be used. In one aspect, current limiter circuit 30 can comprise a current mirror circuit, although any type of current limiter circuit 30 is contemplated herein. In certain embodiments, current limiter circuit 30 can be connected at nodes 44 and 46 of apparatus 10 as shown in FIG. 4. In certain embodiments, a plurality of surge protection devices 24 can be provided. Where multiple surge protection devices 24 are provided, each solid state light emitter set (e.g., $S_1, S_2, \ldots, S_N$) of the at least two different solid state light emitter sets can be associated with a different surge protection device 24 of the multiple surge protection devices.

In certain embodiments, when connected at nodes 44 and 46, one or more storage capacitors 32 can be coupled in parallel with string circuit 14 and serially connected LED sets $S_1, S_2, \ldots, S_N$ within current limiter circuit 30. Current limiter circuit 30 can be configured to limit current through string circuit 14 of serially connected LED sets $S_1, S_2, \ldots, S_N$ to an amount that is less than a nominal current provided to string circuit 14. Thus, current limiter circuit 30 can regulate current within apparatus 10 and provide current flow during all portions of a rectified AC waveform (e.g., FIG. 5). This can provide uniform light and color emission, thereby reducing or eliminating perceptible flicker and/or color shifting.

In certain embodiments, current limiter circuit 30 can include first and second transistors Q1, Q2 and one or more resistors R1, R2, R3 connected in a current mirror configuration. In certain embodiments, the current mirror circuit can provide a current limit of approximately $(V_{LED}-0.7)/(R1+R2)\times(R2/R3)$. A voltage limiter circuit 48, (e.g., including but not limited to a Zener diode), can also be provided to limit the voltage developed across the one or more storage capacitors 32. In this manner, one or more storage capacitors 32 can be alternately charged via the driver circuit 12 comprised of the rectifier circuit and discharged via string circuit 14 of serially connected LED sets $S_1, S_2, \ldots, S_N$, in order to reduce output current variation and/or provide more uniform illumination. In certain embodiments, current limiter circuit 30 can also be coupled to an LED set $S_X$, which is included among the plurality of LED sets $S_1, S_2, \ldots, S_N$ in string circuit 14. It is understood that LED set $S_X$ can include single LED chips 40 or multiple LED chips 40 coupled in parallel and/or series with one another. As noted earlier, each LED set $S_1, S_2, \ldots, S_N$ can be mutually exclusive and coupled in series with one another.

Figure 5B:
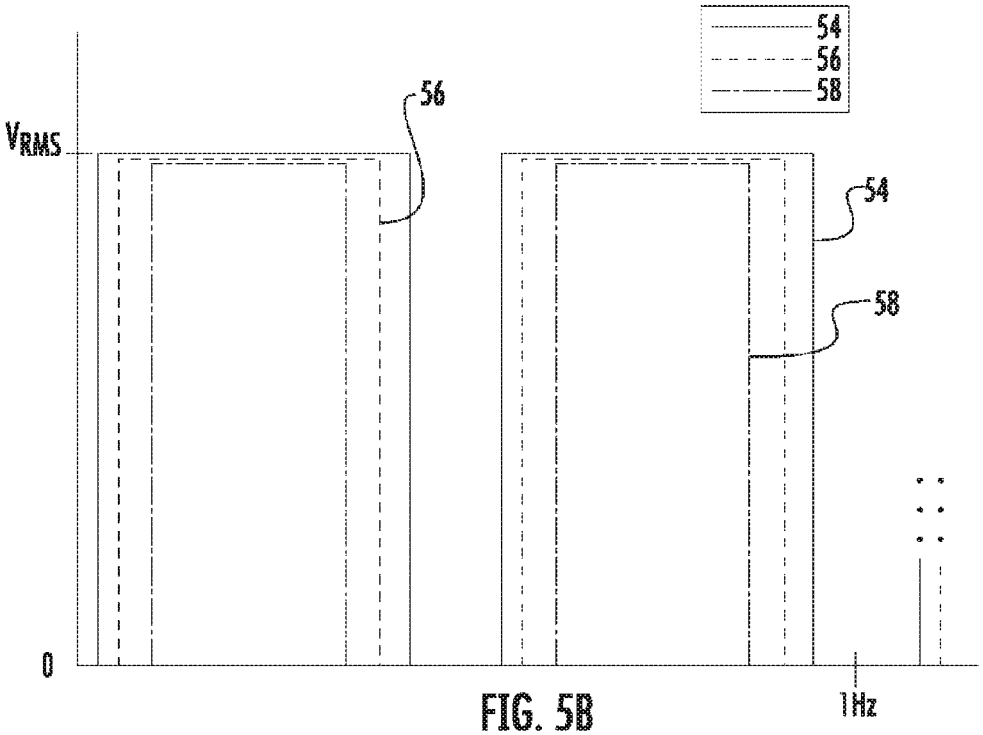
FIG. 5B is a plot of RMS voltage versus time showing duty cycles for three LED sets of a solid state lighting device according to certain embodiments.

FIGS. 5A and 5B graphically illustrate aspects of operation of solid state lighting apparatuses 10 according to certain embodiments, with respect to voltage and/or current. Solid state apparatus 10 can receive AC input directly from an AC power source (not shown). The AC input can have a sinusoidal (or substantially sinusoidal) voltage waveform. As FIG. 5A illustrates, a rectifier circuit 20 (FIGS. 2 and 4) can comprise a full-wave rectifier which can convert the sinusoidal voltage waveform into a fully rectified AC waveform generally designated 50. As rectified AC waveform 50 goes from 0V to its peak voltage $V_{peak}$, different LED sets $S_1, S_2, \ldots, S_N$ can be activated or turn "on" when the voltage is sufficient to run that LED set in addition to any one or more other LED sets that are already on. As the voltage decreases from peak voltage $V_{peak}$ to 0V, LED sets can become deactivated or turn "off" in the opposite sequence. For example, between 0V and $V_{PEAK}$; a first LED set $S_1$ can first become activated at time $t_1$. A second LED set $S_2$ can become activated at time $t_2$, where time $t_2$ is later than and/or occurs after time $t_1$. FIG. 5 also illustrates an optional third LED set $S_3$ becoming activated at time $t_3$ which is later than and/or occurs after times $t_1$ and $t_2$. The LED sets can then turn off in the opposite/reverse sequence. That is, third LED set $S_3$ can be deactivated first, at time $t_r$. Second LED set $S_2$ can be deactivated at time $t_5$, which occurs after time $t_4$ and finally first LED set $S_1$ can be deactivated at time $t_6$ which occurs after times $t_4$ and $t_5$.

In certain embodiments, each LED set can be "on" or active for a given time portion or time interval. For example, first LED set $S_1$ is active for a first time interval $\Delta t_1$ which is longer than second and third time intervals $\Delta t_2$ and $\Delta t_3$ that are associated with second and third LED sets $S_2$ and $S_3$, respectively. As FIG. 5A shows, second LED set $S_2$ is on for the second longest time $\Delta t_2$, and third LED set $S_3$ is on for the shortest amount of time, $\Delta t_a$ during one cycle of rectified AC waveform 50. The activation/deactivation sequence can be repeated over other portions of AC waveform. In certain embodiments, any number of LED sets can be used (e.g., up to an $N^{th}$ set, $S_N$): and each LED set can include one or multiple LED chips 40 (FIG. 4) of any contemplated color and/or color combinations. In certain embodiments utilizing including multiple LED chips in each set, such LED chips 40 (FIG. 4) in each LED set can comprise serial, parallel, or any combination of serial/parallel arrangements. LED chips 40 can be used in a packaged embodiments or COB embodiments.

In certain embodiments, current (generally designated 52 in FIG. 5A) within solid state lighting apparatus 10 can be controlled via current limiter circuit 30 (see FIGS. 3 and 4) by limiting current $i_2$ through one or more LED sets $S_1, S_2, \ldots, S_N$ (see FIG. 4) to a value less than the total current t supplied by driving circuit $i_2$ (FIGS. 1 to 4). In certain embodiments, current L can be limited to $i_2$ by diverting a portion of the total current $i_1$ to charge capacitor 32 (see FIGS. 3, 4). When activated, LED sets $S_1, S_2, \ldots, S_N$ can run at a constant current during each time interval in certain embodiments. An increase in current to the total current $i_1$ can turn on additional LED sets, for example, second and third LED sets $S_2$ and $S_3$. In certain embodiments, when the magnitude of the rectified AC voltage 52 falls below a certain level, such as at times $t_4$ and $t_5$ when $S_3$ and $S_2$ have been turned off, respectively, current $i_2$ through the one or more LED chips 40 in first LED set $S_1$ can be maintained by discharging the one or more storage capacitors 32. In this manner, the one or more LED chips 40 within each activated set can continue to be illuminated.

FIG. 5B graphically illustrates duty cycles associated with the LED sets depicted in FIG. 5A. In general, a duty cycle includes the amount time that each LED set spends in an active state as a fraction of the total time under consideration. In certain embodiments, each LED set $S_1, S_2, \ldots, S_N$ within a lighting apparatus 10 can comprise a different duty cycle. That is, in certain embodiments each LED set can be on and/or off for different amounts of time during a rectified AC waveform 50 (FIG. 5A). For example, a 30% duty cycle means that the set is "on" or activated for approximately 30% of the time and "off" or deactivated approximately 70% of the time; however, each emitter set is preferably activated and deactivated many times per second. For example, each LED set (e.g., $S_1, S_2, \ldots$, and $S_3$ can turn on and off once time for each voltage zero crossing of a raw (input) AC waveform, or once time for each voltage minimum of a rectified AC waveform 50 (see FIG. 5A). If, for example, the AC input signal is supplied at 60 Hertz (60 cycles per second) with two zero crossings per cycle, then the rectified AC waveform will include 120 voltage minima per second, such that each LED set may be activated and deactivated 120 times per second. In various embodiments, apparatuses described herein can be configured to activate and/or deactivate different LED sets at different and/or overlapping times to avoid perceptible flicker and to maintain color point (e.g., turn on/off the right color combinations to maintain a constant color point).

For illustration purposes, only three LED sets have been illustrated as being activated and/or deactivated twice during one cycle of an input AC waveform; however, in certain embodiments, any suitable number of LED sets (e.g., 2, 3, 4, 5, 6, 7, 8, 9, or 10 or more LED sets) may be provided. In certain embodiments. LED sets may be activated and/or deactivated more than twice per cycle, and any suitable AC input frequency may be used to achieve a desired frequency of activation and/or deactivation for one or more LED sets of a solid state lighting apparatus. In certain embodiments, LED sets are activated and deactivated at least 50, 60, 80, 100, 120, 160, 200, 240, or more times per second. Any suitable frequency of activation and deactivation of one or more LED sets be used to reduce and/or eliminate perceived flicker, perceived color shift, and/or perceived differences in luminous flux. In certain embodiments, LED sets $S_1, S_2, \ldots, S_N$ can also comprise overlapping duty cycles, where different LED sets can be activated (e.g. "on") and/or deactivated (e.g., "off") during portions of the same cycle and/or fraction of time.

In certain embodiments, the multiple sets can be configured to operate within (+/−) approximately 15 percent (%) of a root mean square (RMS) voltage $V_{RMS}$ of the AC power source. For illustration purposes in FIG. 5B, each LED set $S_1$, $S_2$, $S_3$ is shown as operating at a voltage approximately equal to RMS voltage $V_{RMS}$, however, in certain embodiments, one or more sets can operate approximately 15% more than or approximately 15% less than RMS voltage V. FIG. 5B illustrates that first LED set $S_1$ can comprise a first duty cycle 54. For illustration purposes, first LED set $S_1$ can be associated with first duty cycle 54, which can be the longest duty cycle and can range from approximately 25% to approximately 100%. Second LED set $S_2$ can comprise a second duty cycle 56, and third LED set $S_3$ can comprise a third duty cycle 58. Second duty cycle 56 can be the second longest and third duty cycle 58 can be the shortest duty cycle. In certain embodiments, a solid state lighting apparatus 10 can have at least two LED sets having at least two different duty cycles, wherein the duty cycles are different and one duty cycle can be longer than the other. The longest duty cycle can range from approximately 25% to approximately 100% and any subrange therebetween such as approximately 25-50%; approximately 50-75%; and approximately 75-100%. The shortest duty cycle can range from approximately 1% to approximately 80%, and any subranges therebetween such as approximately 1-10%; approximately 10-20%; approximately 20-50%; and approximately 50-80%. In certain embodiments, any number of LED sets with appropriate duty cycle values may be provided. In certain embodiments, duty cycles of one or more LED sets may be adjusted.

During activation and deactivation of LED sets during different portions of the AC cycle, a color point of lighting apparatus can be maintained (e.g., without a perceptible color shift) by turning on and off desired color combinations. This can also be achieved in part by board or substrate 16 design, placement, and/or spacing of differently colored LED chips. For example, as described below in FIGS. 6A to 6E, LED chips of different sets can become physically intermingled and/or strategically placed in an array adjacent or proximate each other over portions of substrate 16 such that upon activation and deactivation, LED chips of some LED sets can activate and compensate for color combinations that may be lost upon deactivation of some other LED sets. Such activation and deactivation of LED sets can be advantageous as it can conserve energy, improve thermal management, and/or improve reliability and lifetime of lighting apparatus 10.

FIGS. 6A to 6E schematically illustrate placement of LED sets over portions of substrate 16. Each LED set can comprise one or more LED chips (e.g., $LED_1$, $LED_2$, . . . $LED_N$) that may embody the same and/or different output color, color temperature, or color point as previously noted. LED chips can be directly mounted over portions of substrate 16 or packaged and portions of the LED package can be directly mounted over portions of substrate 16. Notably, LED chips of different LED sets ($S_1, S_2, \ldots, S_N$) can be strategically placed over portions of substrate 16 such that perceived color shifts and/or flicker that may occur during activation and deactivation of the different LED sets during various portions of a rectified AC cycle (see FIGS. 5A/5B) for different fractions of time can be greatly reduced and/or eliminated.

Figure 6A:
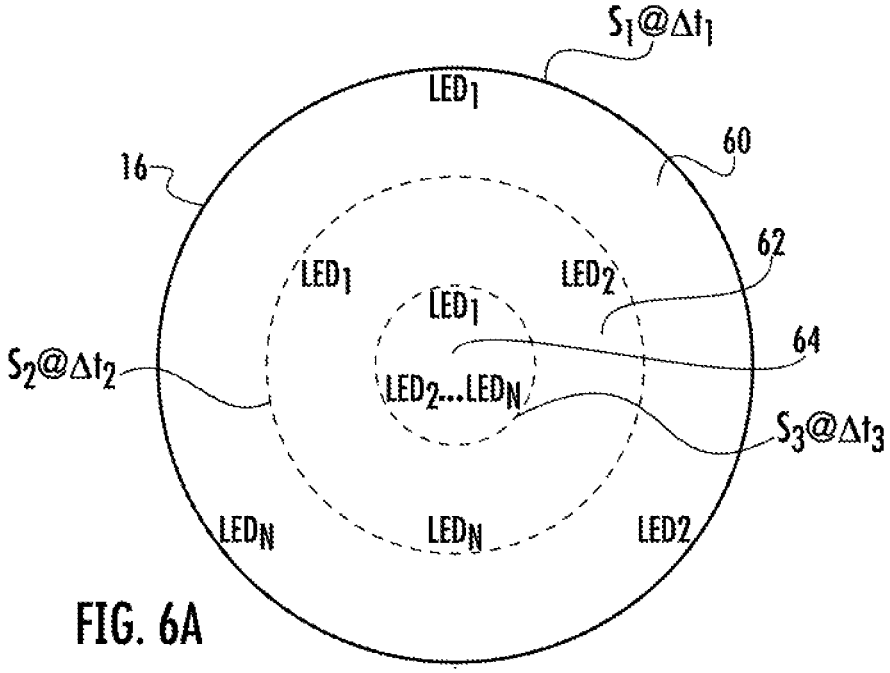
FIGS. 6A to 6D are schematic diagrams illustrating LED chip and/or LED package placement over a substrate according to certain embodiments.

FIG. 6A illustrates a substrate 16 that can be at least partially comprised of concentric or coaxial portions as indicated by the broken or phantom lines. Substrate 16 can comprise any overall shape, for example, substrate 16 can be a substantially square, rectangular, circular, non-circular, symmetrically, and/or asymmetrically shaped board. Substrate 16 can comprise any size, for example, substrate 16 can comprise a substantially circular shaped board that is approximately 3 mm or more in diameter, approximately 4 mm or more in diameter, approximately 5 mm or more in diameter, approximately 7 mm or more in diameter, approximately 10 mm or more in diameter, or more than approximately 20 mm in diameter. In other aspects, substrate 16 can comprise a substantially square or rectangular shaped board having one side that is approximately 3 mm or more in length, approximately 5 mm or more in length, approximately 7 mm or more in length, approximately 10 mm or more in length, approximately 15 mm or more in length, approximately 20 mm or more in length, or more than approximately 30 mm in length. Substrate 16 can comprise any thickness, for example, approximately 0.5 mm or more, approximately 1 mm or more, approximately 2 mm or more, approximately 2.5 mm or more, approximately 3 mm or more, approximately 4 mm or more, or more than approximately 5 mm.

Different LED sets can be arranged over different portions of substrate 16. In certain embodiments, one or more LED chips of one LED set can be physically intermingled, adjacent, and/or closely packed proximate to one or more other LED chips of one or more other LED sets. In certain embodiments, LED chips of different sets form a singular, uniform array of LED chips. For example and as FIG. 6A illustrates, in certain embodiments, first LED set $S_1$ can be disposed over a first portion 60 of substrate 16, second LED set $S_2$ can be disposed over a second portion 62 of substrate 16, and third LED set $S_3$ can be disposed over a third portion 64 of substrate 16.

In certain embodiments, LED chips (e.g., $LED_1$, $LED_2$, . . . , $LED_N$) of first LED set $S_1$ can be adjacent and/or closest to LED chips of second LED set $S_2$. LED chips of second LED set $S_2$ can be disposed between LED chips of first LED set $S_1$ and third LED set $S_3$. As known in the art, LED chips heat up during operation. Thus, in certain embodiments, LED chips of each LED set can comprise a staggered and/or physically intermingled arrangement for spreading heat across different portions of substrate 16 to improve heat dissipation therefrom 16 and/or to prevent hot spots from occurring in concentrated areas or regions of substrate 16, such as regions directly under or adjacent to the LED chips. In certain embodiments, LED chips of some LED sets can be intermingled and/or positioned adjacent LED chips of other LED sets in any suitable method, for example, by overlapping strings of LED chips, using flex circuitry components, and/or cross-circuitry components such as embedded electrical traces, conductive vias, and/or jumper elements to transfer current through and/or across portions of substrate 16 and into respective LED chips of different LED sets.

As shown in FIG. 6A, in certain embodiments, first portion 60, second portion 62, and third portion 64 can comprise substantially circular and/or ring shaped portions that can be coaxial and/or concentric, and the respective LED sets $S_1$, $S_2$, $S_3$ may be arranged concentrically, with the sets arranged within or between boundaries of overlapping concentric circles. In certain embodiments, a set of solid state light emitters having a smallest duty cycle (e.g., $S_3$) is disposed proximate to a center of the substrate 16. This can assist with and/or improve thermal management properties associated with substrate 16. In certain embodiments, second portion 62 is arranged along a peripheral portion of third portion 64 and first portion 60 is arranged along a peripheral portion of second portion 62. As FIG. 6A illustrates, third LED set $S_3$ can be active for $\Delta t_3$, which can be the shortest amount of time and third LED set $S_3$ can comprise the shortest duty cycle of each LED set used in apparatus 10 (see FIGS. 5A and 5B). This allows LED chips that are active or "on" for a shortest amount of time to be disposed proximate a center of substrate 16, in third portion 64. This can advantageously improve thermal management properties associated with substrate 16, by allowing heat to spread away from the center of substrate 16.

Positioning emitters having smaller duty cycles closer to a center of a substrate may aid in thermal dissipation and in promoting longevity of solid state emitters, by reducing thermal load (and reducing hot spots) proximate to the center of the substrate. Second LED set $S_2$, having the second longest duty cycle and on for the second longest (or shortest) time $\Delta t_2$ (FIG. 5A) can be disposed proximate a middle portion of substrate 16 and first LED set $S_1$ can be disposed proximate the outermost edge regions of substrate 16. Thus, the LED set having the longest duty cycle (e.g., first LED set $S_1$) and that is active for a longest time (e.g., $\Delta t_1$) can be positioned farthest from the center of substrate 16. In certain embodiments, third LED set $S_3$ can comprise more LED chips than either or both of the first $S_1$ and second $S_2$ LED sets. In certain embodiments, at least twice as many LED chips are disposed in the central portion (e.g., third portion 68) of substrate 16 than in a peripheral area. In certain embodiments, a central portion (e.g., third portion 68) of substrate 16 can comprise no more than 50% of a spatial area of substrate 16, no more than 30% of a spatial area of substrate 16, or no more than 10% of the spatial area of substrate 16.

In certain embodiments, first, second, and third portions 60, 62, and 64, respectively, can also comprise concentric shapes and/or rings that are substantially square, rectangular, or non-circular. In other aspects, the portions can be non-concentric, for example, parallel strips or other adjacent portions of substrate 16. LED chips of first LED set $S_1$ can be adjacent LED chips of both second LED set $S_2$ and third LED set $S_3$ to form a pattern or array. Any arrangement of LED sets $S_1$, $S_2$, . . . , $S_N$ over portions of substrate 16 is contemplated. In certain embodiments, substrate 16 can comprise only two or more than three portions for receiving only two or more than three sets of LED chips. In certain embodiments, the number of substrate portions corresponds to the number of LED sets.

Figure 6B:
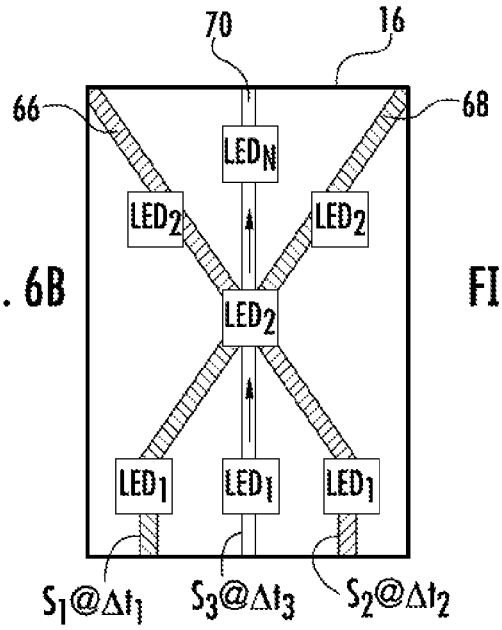
Figure 6C:
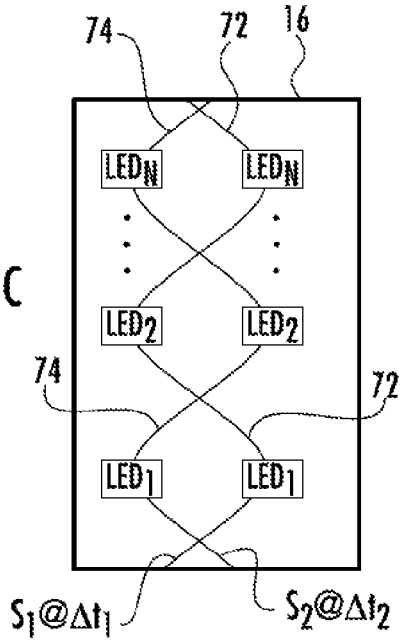

FIGS. 6B and 6C illustrate positioning of LED chips $LED_1$, $LED_2$, . . . , $LED_N$ along overlapping portions of electrical traces or circuits of substrate 16, such that LED chips of different LED sets physically intermingle or form a uniform array of LED chips (i.e., while remaining electrically mutually exclusive within the respective LED set). In certain embodiments, LED chips of different sets may be disposed proximate to one another to thereby reduce or eliminate perceived color shifts, perceived flux (e.g., spatial or directional) flux variations, and/or perceived flicker during operation of lighting apparatus.

In certain embodiments, and as illustrated in FIG. 6B, first and second LED sets $S_1$ and $S_2$ can be disposed over first and second traces 66 and 68, respectively. First and second traces 66 and 68 are shown schematically and for illustration purposes only. Such traces can, but may not be visible along an exposed surface of substrate, as conductive traces may be arranged on opposing substrate surfaces and/or can be at least partially disposed internal to substrate 16. Traces 66 and 68 can comprise crossing-circuitry components utilizing electrically conductive vias or "through-holes" adapted to convey electrical current internally and/or to different surfaces of substrate 16. In certain embodiments, portions of first and second traces 66 and 68 can indirectly overlap, and at least one LED chip of first LED set $S_1$ can be disposed proximate at least one LED chip of third LED set $S_3$. In certain embodiments, at least one insulating material (e.g., an insulating layer of substrate 16) can be physically disposed between overlapping portions of traces 68 and 70 such that electrical traces remain electrically insulated from each other.

In certain embodiments, traces 66 and 68 can comprise overlapping and/or braided portions of electrically insulated flexible conductors or circuit-containing substrates (e.g., circuit boards). In certain embodiments, third LED set $S_3$ can be disposed along portions of a third trace 70, which can be disposed proximate a center line or center portion of substrate 16. In certain embodiments, LED chips of first LED set $S_1$ comprising a longest duty cycle can be positioned directly adjacent to and/or closely packed with, LED chips of third LED set $S_3$ comprising a shortest duty cycle. Any number of LED chips and/or LED sets can be used to place LED chips that are active the longest amount of time next to LED chips that are active the least amount of time to alleviate noticeable color shifts, flux variations, and/or flicker during operation. Such placement can also advantageously improve thermal management of lighting apparatuses disclosed herein by efficiently spreading heat across different regions and away from the center of substrate 16, and avoiding or reducing hot spots during operation.

FIG. 6C illustrates LED chips of first LED set $S_1$ and second LED set $S_2$ disposed along portions of overlapping electrical circuitry or first and second electrical conductors or traces 72 and 74, respectively. In certain embodiments, traces 74, 76 may be formed on one or more surfaces of substrate 16. In certain embodiments, traces 74, 76 may include insulated conductors that may or may not be affixed to a substrate. As FIG. 6C illustrates, LED chips of first LED set $S_1$ can be disposed between at least two LED chips of second set $S_2$, and vice versa. In certain embodiments, each set may be symmetrically arranged within or along a portion of substrate 16.

In certain embodiments, a solid state lighting apparatus can comprise multiple LED chips arranged with azimuthal and/or lateral symmetry within or along portions of substrate 16. Such arrangement can advantageously spread heat more efficiently by allowing LED chips that are active the longest amount of time and having a largest duty cycle alternate positions along substrate 16 such that they are not concentrated in one portion or area of substrate 16. This arrangement can also allow LED chips that are on the longest to be positioned closest to LED chips that have a shorter and/or a shortest duty cycle thereby reducing color shifts and/or flicker, as large gaps between inactive LED chips can be lessened or bridged by LED chips that are in an active state. In certain embodiments, LED chips of one set can be placed any suitable distance from LED chips of another set. For example, LED chips of different sets can be spaced apart a distance of approximately 0.05 mm (e.g., 50 μm) or more, approximately 0.1 mm (e.g., 100 μm) or more, approximately 0.2 mm or more, approximately 0.5 mm or more, approximately 1 mm or more, approximately 2 mm or more, approximately 5 mm or more, approximately 1 cm or more, or more than 2 cm.

Figure 6D:
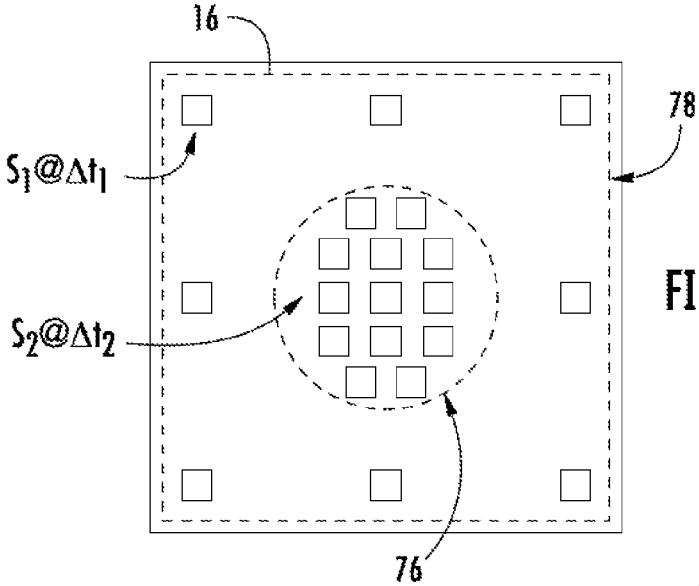

In certain embodiments and as illustrated in FIG. 6D, LED chips of first LED set $S_1$ and second LED set $S_2$ can be disposed over adjacent portions of substrate 16. LED chips within first and second sets $S_1$ and $S_2$ are schematically illustrated as squares, but chips can be rectangular in shape, have straight sides, beveled sides, or any suitable size, design, and/or shape of chip. Second set $S_2$ can be activated or "on" for a shorter amount of time than first set $S_1$ as described in FIGS. 5A and 5B, thus, LED chips within second set $S_2$ can be positioned in a central portion of substrate 16, generally designated 76. Central portion 76 can, but does not have to be circular in shape. LED chips within first set $S_1$ can be positioned within a peripheral portion of substrate 16, generally designated 78, that is disposed outside of and/or about a perimeter of central portion 76. Notably, central portion 76 can have more LED chips concentrated therein than peripheral portion 78. That is, in certain embodiments, central portion 76 can comprise multiple chips closely packed in an array that can be surrounded by LED chips arranged in peripheral portion 78. LED chips in peripheral portion 78 can be both less in number and spaced farther apart than LED chips in central portion 76. As LED chips in central portion 76 can be activated a shorter amount of time than LED chips in peripheral portion 78, heat can dissipate from and spread more efficiently from portions of substrate 16.

Figure 6E:
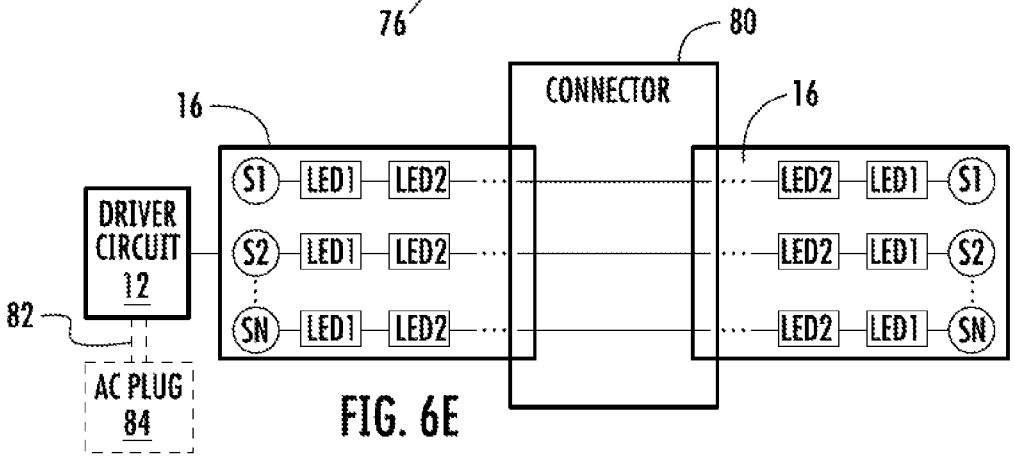
FIG. 6E is a schematic diagram illustrating a first and second arrays of solid state light emitters (e.g. LEDs) associated with first and second body structures, respectively, that are connected by at least one electrical connector.

In certain embodiments and as schematically illustrated in FIG. 6E, one or more sets $S_1, S_2, \ldots, S_N$ of LED chips may be disposed over portions of one or more adjacent substrates 16. Rigid or non-rigid (e.g., flexible) substrates are contemplated. In certain embodiments, each substrate 16 can comprise a rope-light, flexible, braided, and/or expandable string type of substrate adapted to provide, for example, under-cabinet lighting. In certain embodiments, substrate 16 can include an elongated body structure that is flexible. In certain embodiments, each substrate 16 can comprise an array of LED chips, optionally formed in sets $S_1, S_2, \ldots, S_N$, and more than two adjacent substrates 16 may be provided. At least one electrical connector 80 (optionally including one or more electrical connectors associated with each substrate) can be disposed between portions of adjacent substrates 16 and/or between portions of adjacent strings of LED chips.

In certain embodiments, electrical connector(s) 80 can be adapted to permit electrical communication between the first array of LED chips (e.g., LED1, LED2, etc.) disposed over the first substrate 16 (e.g., shown at left in FIG. 6E, and between a second array of LED chips disposed over the second substrate 16 (e.g., shown at the right in FIG. 6E). At least two different sets of LED chips can be connected via electrical connector(s) 80. In certain embodiments, electrical connector(s) 80 can be configured to connect at least a first set $S_1$ associated with a first substrate (e.g., shown at left in FIG. 6E) to at least a first set $S_1$ associated with a second substrate (e.g., shown at right in FIG. 6E). Similarly, electrical connector(s) 80 can be adapted to connect more than two different sets of LED chips on adjacent substrates 16. For example, in certain embodiments a second set $S_2$ and/or N number of sets $S_N$ (where N is a whole integer equal to or greater than 1) can be disposed over portions of adjacent substrates 16 and electrically connected via connector(s) 80. In certain embodiments, each set $S_1, S_2, \ldots, S_N$ includes multiple LED chips (wherein each set may include LED chips of different peak wavelengths or other characteristics), and each set $S_1, S_2, \ldots, S_N$ can be configured to be activated and/or deactivated at different times relative to one another during portions of an AC waveform or AC cycle as described in FIG. 5A.

Still referring to 6E, in certain embodiments and as illustrated in phantom lines, a solid state lighting apparatus may optionally include an external cord or connector 82 and an AC plug 84. in certain embodiments, external cord or connector 82 and AC plug 84 can advantageously permit apparatuses as disclosed herein to be directly plugged into an AC power source (not shown). In certain embodiments, external cord or connector 82 can include one or more insulated wires adapted to connect the AC power source directly to driver circuit 12 without requiring an on-board switched mode power supply.

Figure 7A:
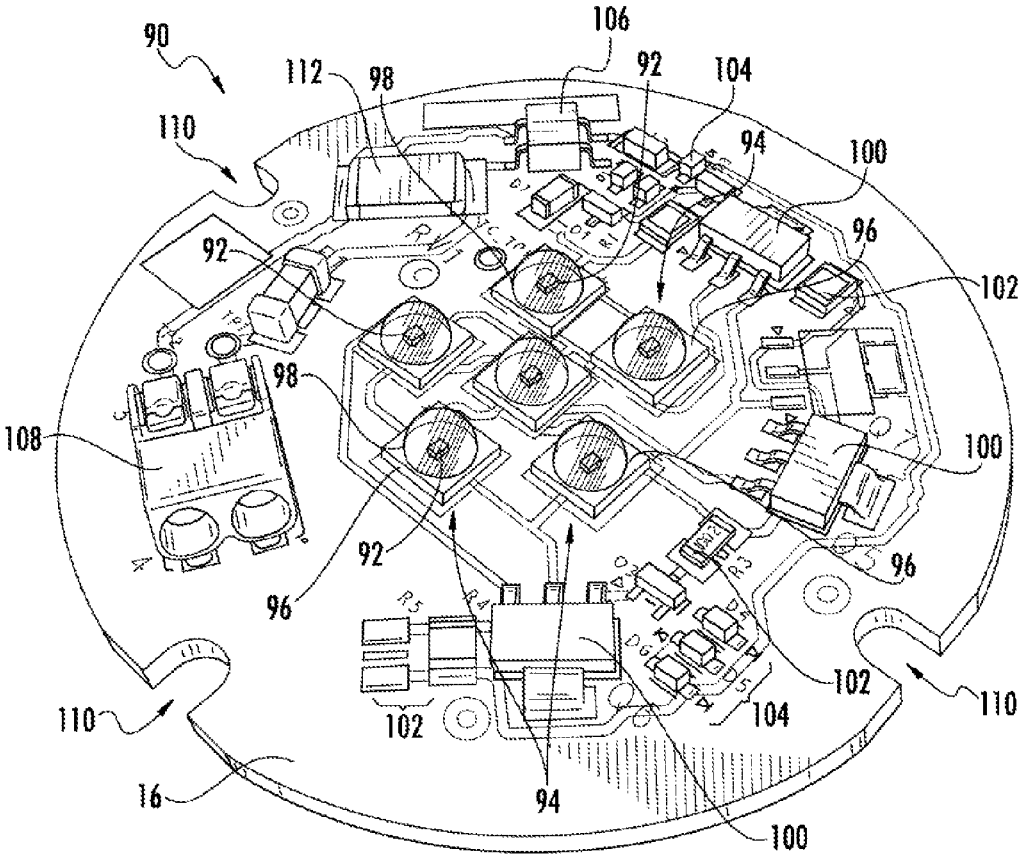
FIGS. 7A and 7B are perspective views illustrating a solid state lighting apparatus including multiple solid state light emitters, associated circuitry, and reflective structures arranged on or over a substrate according to certain embodiments.
Figure 7B:
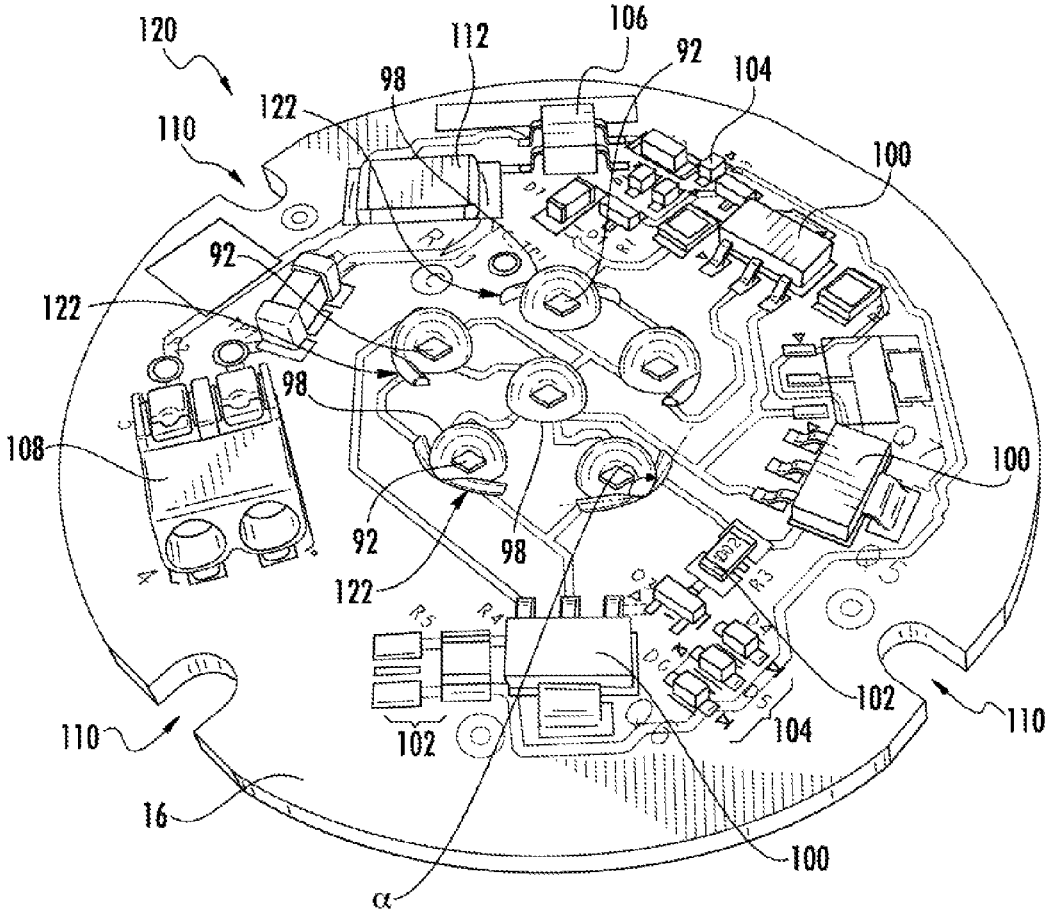
Figure 8A:
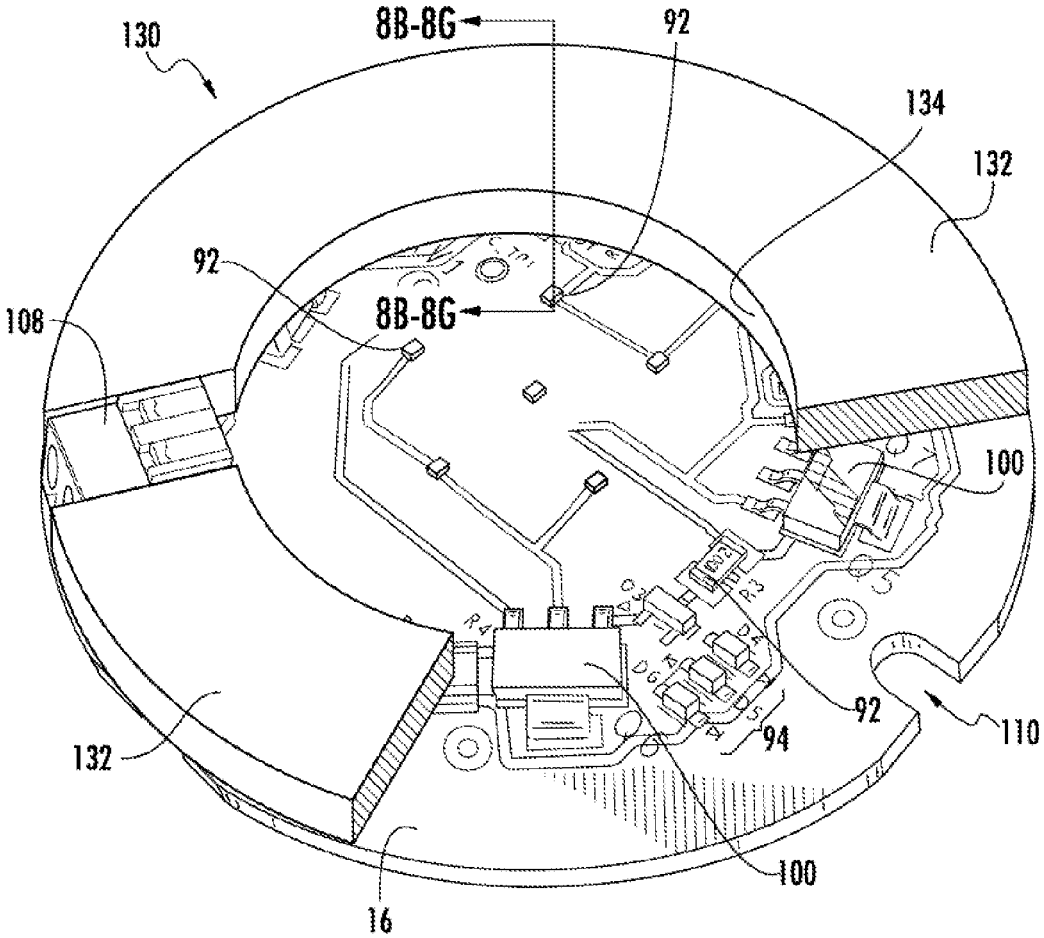
FIG. 8A is a perspective view illustrating a solid state lighting apparatus including multiple solid state light emitters, associated circuitry, and reflective structures or coatings arranged on or over a substrate according to certain embodiments.

FIGS. 7A, 7B, and BA are perspective views illustrating solid state lighting apparatuses. FIG. 7A illustrates a first solid state lighting apparatus, generally designated 90. FIG. 7B illustrates a second solid state lighting apparatus, generally designated 120, being similar in form and function to apparatus 90, however, solid state lighting apparatus 120 can utilize COB LED chips 92 as opposed to packaged LED chips 92. In addition, each LED chip 92 in FIG. 7B may have associated therewith at least one reflective structure disposed thereabout. Such reflective structures can optionally include optical elements, generally designated 122 extending f, which may include one or more wing portions, darns, or "damlets". FIG. 8A illustrates a third solid state lighting apparatus, generally designated 130, which can be similar in form to apparatuses 90 and 120, however, one or more electrical components (such as driving driver circuit components or elements) can be at least partially and/or fully coated by a reflective coating and/or covered by one or more reflective dams.

Referring to FIG. 7A, solid state lighting apparatus 90 can be the same as or similar in form and function to apparatus 10 previously described in schematic detail. Solid state apparatus 90 can comprise substrate 16 which may include portions or components of an LED driver circuit, an LED string circuit, a rectifier circuit, a surge protector, a current diversion circuit, and/or a current limiter circuit disposed or mounted thereon as previously described. In certain embodiments, substrate 16 can comprise a portion of a printed circuit board (PCB), a metal core printed circuit board (MCPCB), a flexible printed circuit board, a dielectric laminate (e.g., FR-4 boards as known in the art) or any suitable substrate for mounting LED chips and/or LED packages. In certain embodiments, substrate 16 can be comprised of one or more materials arranged to provide desired electrical isolation and high thermal conductivity. In some embodiments, at least a portion of substrate 16 may include a dielectric to provide the desired electrical isolation between electrical traces or components of multiple LED sets. In certain embodiments, substrate 16 can comprise ceramic such as alumina; aluminum nitride, silicon carbide, or a polymeric material such as polyimide, polyester, etc. In certain embodiments, substrate 16 can comprise a flexible circuit board which can allow the substrate to take a non-planar or curved shape allowing for directional light emission with the LED chips also being arranged in a non-planar manner.

In certain embodiments, at least a portion of substrate 16 can comprise a MCPCB, such as a "Thermal-Clad" (T-Clad) insulated substrate material, available from The Bergquist Company of Chanhassen, Minn. A MCPCB substrate may reduce thermal impedance and conduct heat more efficiently than standard circuit boards. In certain embodiments, a MCPCB can also include a base plate on the dielectric layer, opposite the LED string circuit, and can comprise a thermally conductive material to assist in heat spreading. In certain embodiments, the base plate can comprise different material such as copper, aluminum or aluminum nitride. The base plate can have different thicknesses, such within the range of 100 to 2000 μm. Substrate 16 can comprise any suitable material and any suitable thickness (e.g., approximately 0.5 mm to more than 5 mm as previously described).

In certain embodiments, solid state lighting apparatus 90 can comprise a string circuit of multiple solid state light emitters, such as LED chips 92, arranged in multiple mutually exclusive sets. In certain embodiments, each LED chip 92 can be directly disposed over portions of substrate 16 (e.g., COB LED chips) or each LED chip 92 can be disposed in an LED package generally designated 94. In certain embodiments, LED package 94 can comprise a package submount 96 and an optional optical element 98. Optical element 98 can comprise a layer of silicone encapsulant or a glass or overmolded silicone lens. In certain embodiments, a submount 96 can comprise any suitable material, for example, a metal, plastic, ceramic, or combinations thereof. In certain embodiments, submount 96 may include a ceramic based submount comprising alumina ($Al_2O_3$), or aluminum nitride AlN; however, any material is contemplated.

In certain embodiments, electrical traces and/or other circuitry components can be used to permit electrical communication with solid state light emitters arranged in multiple sets of LED chips 92 over substrate 16. As described earlier, in certain embodiments, each LED set can comprise one or more packaged or unpackaged LED chips 92 electrically connected in parallel. Each LED set can be connected in series with other LED sets. In certain embodiments, LED chips 92 can comprise the same color intra-set and/or inter-set. In further aspects. LED chips 92 can comprise different colors intra-set and/or inter-set. Any combination of intra- and inter-set colors, color points, and color temperatures are contemplated. In certain embodiments, current diversion circuits comprised of at least one transistor 100, resistor 102, and diode 104 can be arranged in parallel with each LED set to divert current about and thereby activate and/or deactivate the LED sets during portions of an AC cycle. Current diversion circuits can also comprise multiple transistors 100, resistors 102, and/or diodes 104.

To reduce flicker and/or color shifting during activation and deactivation, LED sets can be placed such that LED chips that are "on" the most amount of time or can be directly adjacent LED chips that are "on" the least amount of time. Stated differently, LED chips having the largest duty cycle can be placed closer (e.g., directly adjacent in a closely packed array) to LED chips having a shorter duty cycle and, optionally the shortest duty cycle of multiple duty cycles. Such placement can also improve thermal management and reduce substrate 16 from accumulating hot spots during elevated operating temperatures.

In certain embodiments, solid state lighting apparatus 90 can comprise a rectifier circuit in the form of a rectifier bridge 106. Rectifier bridge 106 can comprise a portion of the drive circuit of apparatus 10 for supplying power to LED chips 92. An input connector 108 can receive AC signal directly from an AC power source (not shown). Rectifier bridge 106 can then convert the sinusoidal AC waveform into a rectified AC waveform without requiring an on-board switched mode power supply. Input connector 108 can comprise a housing having two inlets for receiving and mechanically and electrically coupling with two electrical wires (not shown) arranged to carry an AC input signal from an AC electrical power source. LED chips 92 can be activated and/or deactivated during different portions of the AC cycle. Solid state lighting apparatus 90 can also be modular in that it can easily be mounted to and/or affixed within any suitable lighting fixture by insertion of attachment members (e.g., fasteners, screws, pins, nails, etc.) into portions of attachment member receiving areas 110. In certain embodiments, receiving areas 110 can be configured to receive portions of insulated external wires (not shown) and direct such wires into portions of input connector 108.

In certain embodiments, solid state lighting apparatus 90 can further comprise at least one surge protection element 112 or surge protection device as previously described in FIGS. 2 to 4. In certain embodiments, a surge protection element 112 may include a MOV. However, any suitable surge protection device or surge protection circuit adapted to protect LED chips 92 from voltage spikes is contemplated. In certain embodiments, surge protector 24 can be built in to apparatus 90 and can be disposed on and directly supported and attached to portions of substrate 16.

Referring to FIG. 7B, solid state lighting apparatus 120 is shown and described. As noted earlier, solid state lighting apparatus 120 can be similar in form and function to previously described apparatuses 10 and 90. In certain embodiments, apparatus 120 can comprise one or more LED chips 92 directly disposed over portions of substrate 16. In certain embodiments, electrical traces or circuitry can electrically connect LED chips 92 into one or more mutually exclusive groups or sets adapted to be activated and/or deactivated at different times relative to one another during a portion within an AC cycle. In certain embodiments, each LED chip 92 can be at least partially covered by a reflective structure. Such reflective structure may optionally include a lens 98. In certain embodiments, each lens 98 can include a raised element adhered to or deposited on a first face of the substrate 16, over one or more LED chips 92. In certain embodiments, or more other reflective structures, such as one or more optical elements 122 can be disposed about portions of LED chips 92. In certain embodiments, a plurality of reflective structures, such as a plurality of optical elements 122 can be disposed about portions of LED chips 92. Reflective structures such as optical elements 122 may also include raised elements adhered to or deposited on the first face of the substrate 16.

In certain embodiments, lens 98 can comprise a substantially circular or non-circular lens base which can be formed directly and/or indirectly over a top surface of substrate 16, and can be disposed over at least one LED chip 92. In certain embodiments, an array of lenses 98 can be molded and/or positioned over a corresponding array of LED chips 92. Lenses 98 can provide environmental and/or mechanical protection of LED chips 92. In certain embodiments, each lens 98 can be associated with one or more novel optical elements generally designated 122. In certain embodiments, optical elements 122 may include one or more extensions extending outwardly from lens 98, or each optical element 122 can be associated with a lens 98 without extending from or being attached to lens 98. For example, in certain embodiments, optical element 122 can be spaced apart from lens 98 (e.g., not attached thereto) and can comprise a dam or damlet about a portion of lens 98 and/or LED chip 92. In certain embodiments, optical elements 122 can be substantially clear or transparent, semitransparent, and/or opaque, and can optionally be adapted to shape or affect a beam pattern output by lighting apparatus 120.

In certain embodiments, a centermost LED chip 92 and corresponding lens 98 may be devoid of an optical element 122, while optical elements 122 can be disposed about outermost LED chips 92 for beam shaping or affecting a pattern of light emitted from the one or more LED chips 92. In certain embodiments, optical elements 122 can comprise an elongated portion or member that may either be formed integrally with each lens 98, or formed and disposed separately from each lens 98. In certain embodiments, multiple optical elements may be provided, including portions formed integrally with each lens and portions formed and disposed separately from each lens. In certain embodiments, optical elements 122 may comprise at least a first portion and optionally a second portion extending outwardly and away from each other and outwardly and away from lens 98. In certain embodiments, optical elements 122 can be disposed or arranged about portions of a lens base. In certain embodiments, each optical element 122 can be an elongated and optionally concave element configured to affect and reflect light in a desired manner. In certain embodiments, an angle $\alpha$ can be disposed between opposing first and second portions of each optical element 122. In one aspect, angle $\alpha$ can comprise an angle of approximately 45° or more, such as an angle of approximately 50° or more, approximately 60° or more, approximately 70° or more, or more than 80°. In certain embodiments, angle $\alpha$ can comprise an angle of approximately 90° or more, such as an angle of approximately 95° or more, approximately 100° or more, approximately 110° or more, approximately 120° or more, or more than 150°.

In certain embodiments, optical elements 122 can be formed integrally with lens 98, for example, formed via a same mold and/or during the same molding step as lens 98. That is, the mold that forms domed lens 98 can be integrated with a mold or mold portion for forming optical element 122. In other aspects, optical element 122 can be formed separately (e.g., via a different mold and/or during a different molding step) than lens 98. Each optical element can 122 can comprise the same material as lens 98, for example, a molded and optionally curable silicone material. In certain embodiments, each optical element 122 can comprise a different material than lens 98, for example, a glass or plastic material. In certain embodiments, optical element 122 can fully extend about (e.g., enclose or encircle) each lens 98. In certain embodiments, each lens 98 and optical element 122 can comprise an optically clear material. In certain embodiments, portions of lenses 98 and optical elements 122 can comprise a semitransparent material, be coated or layered with one or more phosphors or lumiphors, and/or comprise an opaque material.

Referring to FIG. 8A, solid state lighting apparatus 130 is shown and described. Solid state lighting apparatus 130 can be similar in form and/or function to any to previously described apparatuses 10, 90, and/or 120, however, in certain embodiments apparatus 130 can comprise a reflective structure including a reflective coating or reflective darn disposed over one or more electrical components or elements of drive circuit 12 (FIGS. 1 to 4). As FIG. 8A illustrates, in certain embodiments a reflective coating 132 can be disposed over portions of substrate 16 and over portions of electrical driver circuitry disposed over substrate 16. For illustration purposes, a portion of reflective coating 132 has been cut away or removed. An inner wall 134 of reflective coating 132 can comprise any thickness and can be disposed about LED chips 92 (either COB or packaged). In certain embodiments, inner wall 134 can be substantially vertical or can be inclined at any obtuse or acute angle desired to shape or otherwise affect the beam pattern emitted by apparatus 130. Sectional views of various embodiments of apparatus 130 can be seen in FIGS. 8B to 8G. As FIG. 8A further illustrates, in certain embodiments input connector 108 can be rotated outwardly and disposed between portions of reflective coating 132, such that apparatus 130 can be connected to an AC power supply (not shown).

In certain embodiments, covering material or reflective coating 132 can comprise any reflective structure, and can be molded, placed, glued, adhered, or otherwise dispensed over portions of substrate 16 and drive elements, components, or circuitry. This can be advantageous, as reflective coating 132 can reduce or eliminate impingement of light generated by LED chips 92 onto surrounding drive circuitry components or elements (e.g., traces, transistor(s) 100, resistor(s) 102, diode(s) 104, rectifier bridge 106, surge protector 112, etc.). As drive circuitry components can absorb or otherwise interfere with light, coating 132 can advantageously improve brightness of apparatus 130 by improving and/or increasing reflection therefrom by coating components with a reflective structure.

In certain embodiments, covering or coating 132 can comprise a silicone based dam or silicone based coating of any suitable thickness, and can optionally include a white or silver color. In certain embodiments, coating 132 may be dispensed over portions of substrate 16 and can include a white or silver coloring or component adapted and configured to reflect light. In certain embodiments, coating 132 may include a reflective paint that can be brushed, sprayed, or painted on and can optionally including a wavelength conversion material such as one or more phosphors or lumiphors. In certain embodiments, covering or coating 132 can comprise a reflective structure comprised of molded plastic, such as a plastic cap, which can be placed over, or molded in situ (after mounting of electrical components to the substrate 16) over portions of substrate 16 and some or all of the electrical components (e.g., driver circuit components) supported by the substrate 16.

Figure 8B:
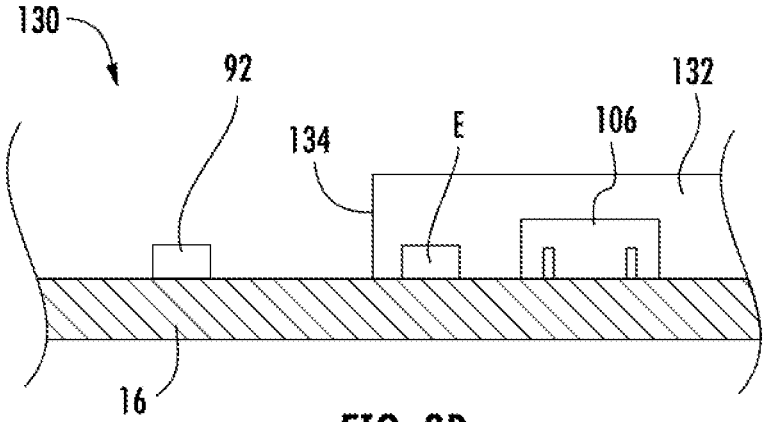
FIGS. 8B to 8G are sectional views of portions of the solid state lighting apparatus of FIG. 8A according to various embodiments.
Figure 8C:
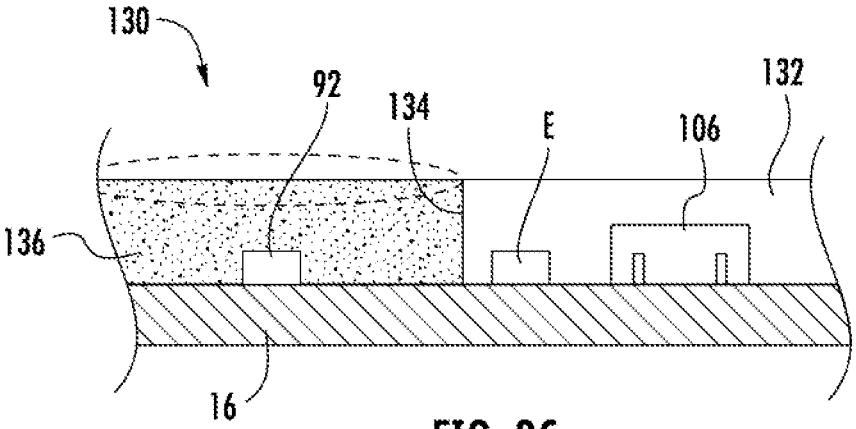

FIGS. 8B to 8G illustrate sectional views of alternative embodiments of apparatus 130. As shown in FIG. 8B, in certain embodiments at least one LED chip 92 and at least one electrical component of driver circuit 12 (FIGS. 1-4), such as rectifier bridge 106, can be covered by and/or disposed below portions of covering material or coating 132. In certain embodiments, inner wall 134 of coating 132 can be disposed adjacent and/or surround one or more LED chips 92 and advantageously reflect light emitted by the LED chips. In certain embodiments, more than one electrical component, such as an adjacent electrical component schematically illustrated as E can also be disposed below portions of coating 132. In certain embodiments, coating can partially and/or fully cover electrical component E and rectifier bridge 106. In certain embodiments, coating 132 can comprise a thin coating covering one or more surfaces of electrical component E, or can comprise a thicker coating or other covering material. Coatings 132 of any size, shape, material, and/or thickness can be provided. As FIG. 8C illustrates, in certain embodiments an encapsulant material 136 can optionally be disposed within one or more portions of coating 132, such as between one or more inner walls 134 of coating or covering material. One or more wavelength conversion materials, such as one or more phosphors or lumiphors, can be disposed within encapsulant material 136. In this aspect, a covering material or coating 132 can act as a dam for containing a volume of encapsulant material 136. In certain embodiments, encapsulant material 136 can be filled to any level within a covering material or coating 132, such as any level convex or concave with respect to coating 132 as illustrated in phantom lines.

Figure 8D:
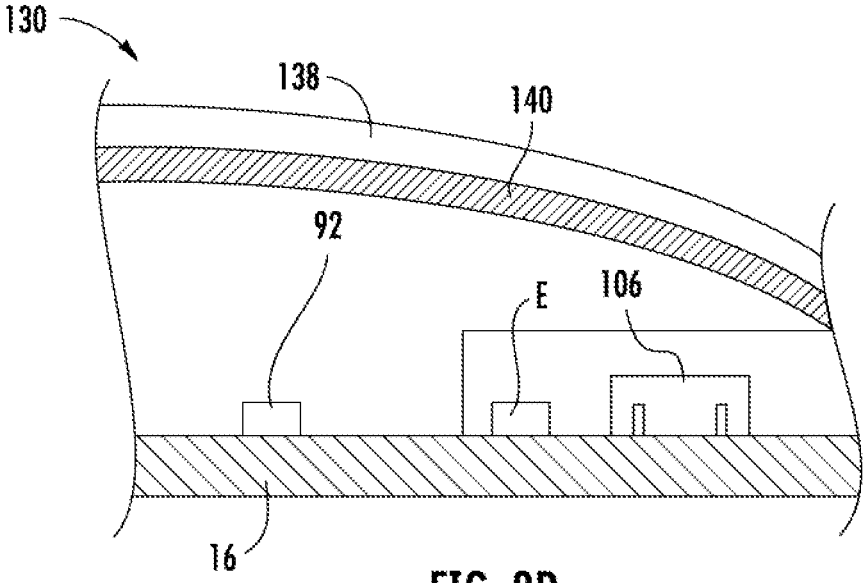

In certain embodiments and as illustrated in FIG. 8D, an optical element and/or reflective structure may be placed over portions of at least one LED chip 92 and covering material or coating 132. In certain embodiments, an optical element 138 comprising a concave shaped portion of concave shaped lens may be placed over portions of apparatus 130. In certain embodiments, an optical element 138 including a convex lens and/or a lens having convex and concave portions can be placed over portions of apparatus 130. In certain embodiments, a wavelength conversion material 140 can be disposed over or on portions of optical element 138, for example, along an inner surface of optical element 138 facing opposing at least one LED chip 92. In certain embodiments, a wavelength conversion material 140 can comprise a remote phosphor, that is, the phosphor may not directly touch LED chip 92 as shown in FIG. 8C, but may be disposed over other portions of apparatus, such as over portions of optical element 138.

Figure 8E:
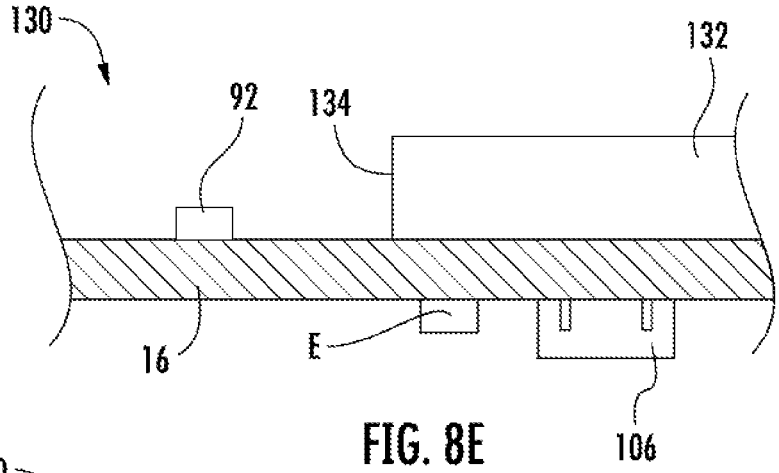

In certain embodiments and as illustrated in FIG. 8E, some or all electrical elements or components can be disposed on a second surface of substrate 16 which opposes a first surface upon which one or more LED chips 92 are disposed. For example, rectifier bridge 106 and electrical component E can be disposed on a lower face of substrate 16. In certain embodiments, one or more LED chips 92 can be disposed on an upper face of substrate 16 which is opposite from the lower face upon which the electrical components are mounted. Covering material or coating 132 can be disposed about portions of one or more LED chips 92, for example, such that inner wall 134 of coating 132 is disposed proximate and/or adjacent outermost LED chips 92 of an array of LED chips.

Figure 8F:
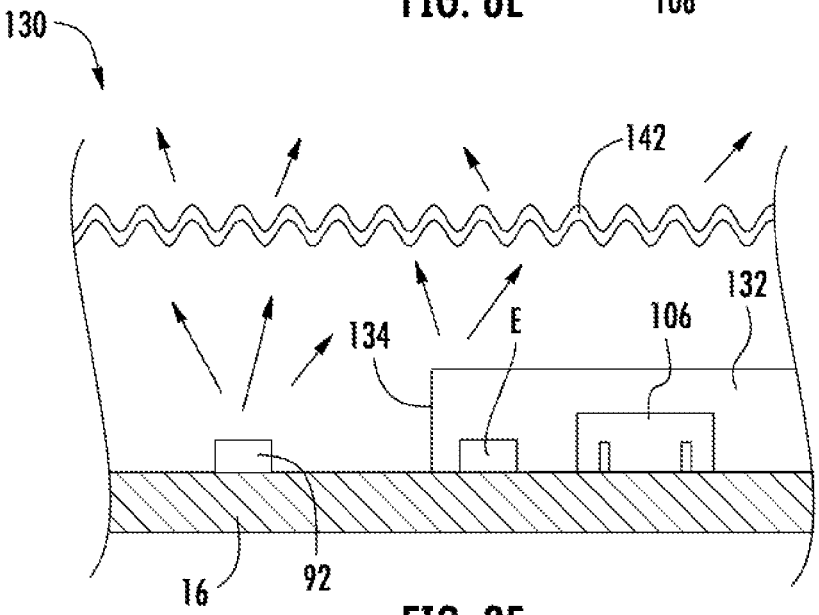

In certain embodiments and as illustrated in FIG. 8F, a reflective structure 142 can be disposed over portions of LED chip 92 and covering material or coating 132. Reflective structure 142 can comprise a diffuser arranged to receive emissions from LED chip 92 and diffusively reflect light in a multitude of different directions. Reflective structure 142 can be disposed over a same surface of apparatus 130 as LED chip 92. Although not shown for illustration purposes, it is further contemplated that reflective structure 142 can be disposed between portions of LED chip 92 and electrical components, such as between LED chip 92 and electrical component E to further reduce or eliminate impingement of light generated by that at least one LED chip 92 on at least one electrical element E of driving circuit 12 (FIGS. 1-4). That is, reflective structure 142 can be adapted to receive light from LED chip 92 and specularly or diffusively reflect the received light. In certain embodiments, reflective structure 142 can be adapted to receive and reflect light from surfaces of covering material or coating 132.

Figure 8G:
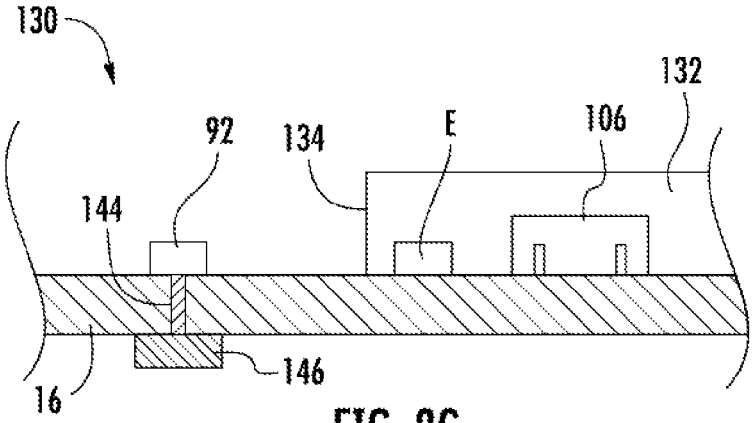

In certain embodiments and as illustrated in FIG. 8G, substrate 16 can comprise at least one electrical through hole or via 144. Via 144 can be configured to electrically connect or enable electrical communication between LED chip 92 and an electrical element 146 disposed on another surface of substrate 16. In certain embodiments, LED chip 92 can be disposed on a surface of substrate 16 opposing a substrate surface on which electrical element 146 is mounted. In certain embodiments, electrical element 146 may include an electrical contact, a solder pad, a heat sink, or an electrical trace element of apparatus 130.

In certain embodiments, solid state lighting apparatuses described herein can deliver approximately 70 LPW or more in select color temperatures, such as cool white or warm white color temperatures (e.g., from approximately 2700 to 7000 K).

Figure 9A:
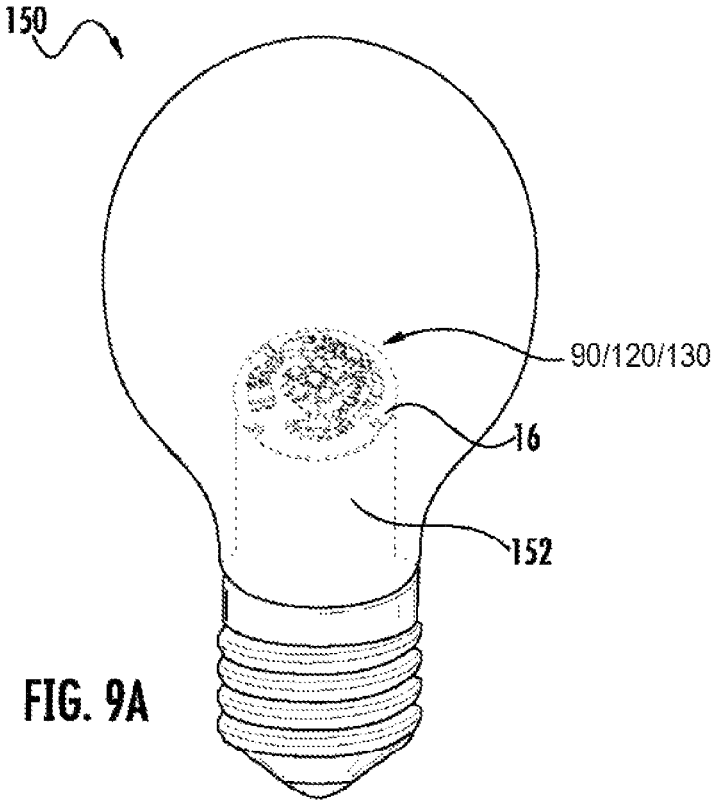
FIG. 9A is a perspective view of a light bulb including at least one solid state lighting apparatus according to certain embodiments.
Figure 9B:
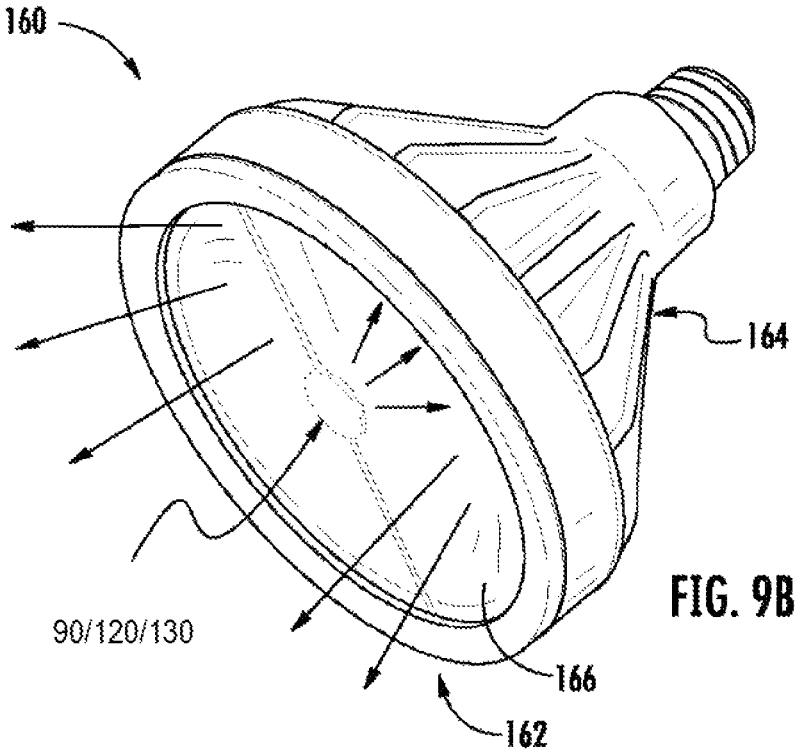
FIG. 9B is a perspective view of a light bulb including a base end, a light transmissive end, a reflective surface, and at least one solid state lightning apparatus according to certain embodiments.

In certain embodiments as illustrated in FIGS. 9A and 9B, at least one solid state lighting apparatus 90, 120, and/or 130 (i.e., designated 90/120/130) may be housed or provided in one or more lighting products, such as in one or more lighting fixtures. Any number of lighting applications, products, and/or fixtures can be provided. For illustration purposes only and without limitation, a first light bulb, generally designated 150 and second light bulb, generally designated 160 are shown in FIGS. 9A and 9B. As FIGS. 9A and 9B illustrate in phantom lines, at least one solid state lighting apparatus 90, 120, and/or 130 can be incorporated within a portion of light bulb 120 and/or light bulb 160. As apparatuses 90, 120, and/or 130 may not be visible from the exterior of the light bulbs, features thereof are illustrated in phantom lines. In certain embodiments, each lighting fixture can comprise only one, or more than one, solid state lighting apparatus as described herein (e.g., lighting apparatus 90, 120, and/or 130).

In certain embodiments as shown in FIG. 9A, substrate 16 of a lighting apparatus 90, 120, and/or 130 can be disposed over a holding member 152 (e.g., a pedestal) and/or or heat transfer element disposed within a portion of light bulb 150. In certain embodiments, substrate 16 can be fastened or screwed into holding member 152 by inserting and affixing attachment members into attachment member receiving areas 110 (FIGS. 7A to 8A). As previously described, solid state lighting apparatuses 90, 120, and/or 130 can comprise multiple mutually exclusive sets of LED chips 92 physically arranged in an array over substrate 16. Solid state lighting apparatuses 90, 120, and/or 130 can advantageously operate directly from an AC power source without the use of an on-board switched mode power supply, thereby reducing cost and encouraging adoption of LED products.

In certain embodiments, solid state lighting apparatuses 90, 120, and/or 130 can be configured to selectively activate and deactivate the multiple LED sets at different times relevant to one another during a portion of an AC cycle. The multiple LED sets can comprise multiple different duty cycles. In certain embodiments, LED chips in each LED set can be selected based upon color, color ratio, color point, targeted wavelength, and/or targeted color temperature to reduce or eliminate perceptible flicker, perceptible flux variation, and/or perceptible color variation that may potentially occur during activation and deactivation of one or more of the LED sets. In certain embodiments. LED chips within LED sets can be selectively placed over portions of substrate 16 for improved thermal properties (e.g., via better heat spreading) and for physically integrating LED chips of LED sets into a tightly packed array for providing improved illumination characteristics. In certain embodiments, solid state lighting apparatuses 90, 120, and/or 130 can comprise flexible substrates 16, surge protectors 112 (FIG. 7A), reflective structures, and/or reflective covering materials or coatings that can be diffusively or specularly reflective.

In certain embodiments as illustrated in FIG. 9B, a light bulb 160 incorporating one or more solid state lighting apparatuses 90, 120, and/or 130 is shown. In certain embodiments, light bulb 160 can comprise a light transmissive end 162 from which light can be transmitted or emitted and a base end 164. In certain embodiments, light bulb 160 can further comprise at least one reflective surface 166. In certain embodiments, reflective surface 166 can be cup-shaped, have a cup-shaped body, and/or comprise a concave or convex cavity portion. Reflective surface 166 can be diffusively reflective or specularly reflective, and can be white or silver in color. In certain embodiments, reflective surface 166 can be adapted to permit transmission of light reflected by the reflector to be reflected or directed towards light transmissive end 162. That is, the array of LED chips 92 (FIGS. 7A to 8A) can be arranged towards the cavity to transmit emissions towards reflective surface 166.

In certain embodiments, light from apparatus 90, 120, and/or 130 can be emitted in a direction toward base end 164 to impinge upon reflective surface 166 for reflection of light toward light transmissive end 162. Thus, light emissions transmitted via light transmissive end 162 can consist of emission reflected by reflective surface 166 and can be devoid of direct emissions from the array of LED chips disposed over apparatuses 90, 120, and/or 130. In certain embodiments, solid state lighting apparatus 90, 120, and/or 130 can be controlled to selectively switch multiple LED sets between active and inactive states. In certain embodiments, lighting bulb 160 can comprise or be embodied in a can lamp or light, a down light, and/or a parabolic aluminized reflector lamp (PAR) lamp, configured to maintain a uniform color temperature without noticeable flicker, even during switching LED sets between active and inactive states. In certain embodiments, lighting fixture can be adapted to reflect light via one or more reflective surfaces, and can include surge protection built into the LED lighting source (e.g., apparatus 90, 120, or 130). It is to be appreciated that light fixtures of any desired type or configuration may include lighting apparatuses as described herein.

Embodiments as disclosed herein may provide one or more of the following beneficial technical effects: reduced cost of solid state lighting devices; reduced size or volume of solid state lighting devices; reduced perceptibility of flicker of solid state lighting devices operated with AC power; reduced perceptibility of variation in intensity (e.g., with respect to area and/or direction) of light output by solid state lighting devices operated with AC power; reduced perceptibility of variation (e.g., with respect to area and/or direction) in output color and/or output color temperature of light output by solid state lighting devices operated with AC power; improved dissipation of heat (and concomitant improvement of operating life) of solid state lighting devices operated with AC power; improved manufacturability of solid state lighting devices operated with AC power; improved ability to vary color temperature of emissions of solid state lighting devices operated with AC power; improved ability to vary beam pattern and/or direction of light output by solid state lighting devices operated with AC power; improved light extraction; reduced absorption of light by driver circuitry components; and reduced impingement of light upon driver circuitry components.

While the invention has been has been described herein in reference to specific aspects, features, and illustrative embodiments, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Various combinations and sub-combinations of the structures and features described herein are contemplated and will be apparent to a skilled person having knowledge of this disclosure. Any of the various features and elements as disclosed herein may be combined with one or more other disclosed features and elements unless indicated to the contrary herein. Correspondingly, the invention as hereinafter claimed is intended to be broadly construed and interpreted, as including all such variations, modifications and alternative embodiments, within its scope and including equivalents of the claims.

What is claimed is:

1. A solid state lighting apparatus adapted to operate with alternating current (AC) received from an AC power source, the lighting apparatus comprising:

a substrate;

an array of solid state light emitters arranged on or supported by he substrate, the array of solid state light emitters comprising a plurality of electrically mutually exclusive solid state light emitter sets each comprising multiple solid state light emitters, wherein at least two different solid state light emitter sets of the plurality of electrically mutually exclusive solid state light emitter sets are arranged to be activated and/or deactivated at different times relative to one another during at least a positive portion of an AC cycle;

at least one driver circuit component arranged on or over the substrate and arranged to drive the array of solid state light emitters; and at least one reflective structure positioned between one or more solid state light emitters of the array of solid state light emitters and the at least one driver circuit component and arranged to reduce or eliminate absorption by the at least one driver circuit component of light generated by the one or more solid state light emitters, wherein the at least one reflective structure comprises at least one of the following features (a) or (b): (a) the at least one reflective structure is arranged over and in contact with at least a portion of the at least one driver circuit component, or (b) the at least one reflective structure comprises at least one raised element that is adhered to or deposited on a first face of the substrate and has a height exceeding a height of at least one solid state light emitter of the array of solid state light emitters;

wherein the lighting apparatus is devoid of any switched-mode power supply providing AC to DC conversion utility and is arranged in electrical communication between the AC power source and the array of solid state light emitters.

2. The lighting apparatus according to claim 1, wherein the substrate comprises a plurality of electrically conductive traces along at least one face of the substrate.

3. The lighting apparatus according to claim 1, wherein the at least one reflective structure comprises at least one raised element that is adhered to or deposited on a first face of the substrate and has a height exceeding a height of at least one solid state light emitter of the array of solid state light emitters.

4. The lighting apparatus according to claim 1, wherein the at east one reflective structure comprises a plurality of reflective structures.

5. The lighting apparatus according to claim 1, wherein the at least one reflective structure is arranged over and in contact with at least a portion of the at least one driver circuit component.

6. The lighting apparatus according to claim 1, wherein the at least one reflective structure is diffusively reflective or specularly reflective.

7. The lighting apparatus according to claim 1, wherein the at least one reflective structure comprises at least one of a white color or a silver color.

8. The lighting apparatus according to claim 1, wherein the at least one reflective structure comprises silicone.

9. The lighting apparatus according to claim 1, wherein the at least one reflective structure comprises a diffuser or lens.

10. The lighting apparatus according to claim 9, further comprising at least one other reflective structure disposed along or bounding at least a portion of the diffuser or lens.

11. The lighting apparatus according to claim 1, wherein the at least one reflective structure comprises a dispensed silicone dam.

12. The lighting apparatus according to claim 1, wherein the at least one reflective structure comprises a reflective coating.

13. A solid state lighting apparatus adapted to operate with alternating current (AC) received from an AC power source, the lighting apparatus comprising:

a substrate including a first surface, a second surface opposing the first surface, and at least one lateral edge bounding at least a portion of the first surface and the second surface;

an array of solid state light emitters arranged on or supported by the first surface of the substrate, the array of solid state light emitters comprising a plurality of electrically mutually exclusive solid state light emitter sets each comprising multiple solid state light emitters, wherein at least two different solid state light emitter sets of the plurality of electrically mutually exclusive solid state light emitter sets are arranged to be activated and/or deactivated at different times relative to one another during at least a positive portion of an AC cycle;

at least one driver circuit component arranged on or over the first surface of the substrate and arranged to drive the array of solid state light emitters; and a reflective coating arranged over at least a portion of the at least one driver circuit component, wherein the reflective coating is arranged to reduce or eliminate absorption by the at least one driver circuit component of light generated by one or more solid state light emitters of the array of solid state light emitters;

wherein the lighting apparatus is devoid of any switched-mode power supply in electrical communication between the AC power source and the array of solid state light emitters.

14. The lighting apparatus according to claim 13, wherein the reflective coating is arranged over an entirety of the at least one driver circuit component.

15. The lighting apparatus according to claim 13, wherein the substrate comprises a plurality of electrically conductive traces along at least one of the first surface or the second surface of the substrate.

16. The lighting apparatus according to claim 13, wherein the reflective coating is diffusively or specularly reflective.

17. The lighting apparatus according to claim 13, wherein the reflective coating comprises at least one of a white color or a silver color.

18. The lighting apparatus according to claim 13, wherein the reflective coating is dispensed, painted, or sprayed over portions of the at least one driver circuit component.

19. The lighting apparatus according to claim 13, wherein the reflective coating comprises a wavelength conversion material.

20. A solid state lighting apparatus adapted to operate with alternating current (AC) received from an AC power source, the lighting apparatus comprising:

a substrate including a first surface, a second surface opposing the first surface, at least one lateral edge bounding at least a portion of the first surface and the second surface, electrical traces arranged on or over the first surface, and electrical traces arranged on or over the second surface;

an array of solid state light emitters arranged on or over the first surface, the array of solid state light emitters comprising a plurality of electrically mutually exclusive solid state light emitter sets each comprising multiple solid state light emitters, wherein at least two different solid state light emitter sets of the plurality of electrically mutually exclusive solid state light emitter sets are arranged to be activated and/or deactivated at different times relative to one another during at least a positive portion of an AC cycle; and at least one driver circuit component arranged on or over the second surface and arranged to drive the array of solid state light emitters;

wherein the lighting apparatus is devoid of any switched-mode power supply in electrical communication between the AC power source and the array of solid state light emitters.

21. The lighting apparatus according to claim 20, being devoid of any driver circuit component arranged on or over the first surface.

22. A solid state lighting apparatus adapted to operate with alternating current (AC) received from an AC power source, the lighting apparatus comprising:

a substrate;

an array of solid state light emitters arranged on or supported by the substrate, the array of solid state light emitters comprising a plurality of electrically mutually exclusive solid state light emitter sets each comprising multiple solid state light emitters, wherein at least two different solid state light emitter sets of the plurality of electrically mutually exclusive solid state light emitter sets are arranged to be activated and/or deactivated at different times relative to one another during at least a positive portion of an AC cycle; and multiple surge protection components arranged on or over the substrate and adapted to reduce or eliminate transmission of voltage transients exceeding a line voltage to the array of solid state light emitters, wherein the at least two different solid state light emitter sets are each associated with a different surge protection component of the multiple surge protection components;

wherein the lighting apparatus is devoid of any switched-mode power supply in electrical communication between the AC power source and the array of solid state light emitters.

23. The lighting apparatus according to claim 22, further comprising at least one driver circuit component arranged on or over the substrate and arranged to drive the array of solid state light emitters.

24. A solid state lighting apparatus adapted to operate with alternating current (AC) received from an AC power source, the lighting apparatus comprising:

a first array of solid state light emitters including a first plurality of individually controllable solid state light emitter sets each comprising multiple solid state light emitters arranged in or on a first elongated body structure, wherein at least two different solid state light emitter sets of the first plurality of individually controllable solid state light emitter sets are arranged to be activated and/or deactivated at different times relative to one another during at least a positive portion of an AC cycle;

at least one driver circuit component arranged to drive the first array of solid state light emitters; and at least one electrical connector arranged to permit electrical communication between the first array of solid state light emitters and a second array of solid state light emitters that includes a second plurality of individually controllable solid state light emitter sets each comprising multiple solid state light emitters arranged in or on a second elongated body structure, wherein at least two different solid state light emitter sets of the second plurality of individually controllable solid state light emitter sets are arranged to be activated and/or deactivated at different times relative to one another during the at least a positive portion of the AC cycle, with a first solid state light emitter set of the first array of solid state light emitters in electrical communication with a first solid state light emitter set of the second array of solid state light emitters, and with a second solid state light emitter set of the first array of solid state light emitters in electrical communication with a second solid state light emitter set of the second array of solid state light emitters; and wherein the lighting apparatus is devoid of any switched-mode power supply in electrical communication between the AC power source and at least one of the first array of solid state light emitters or the second array of solid state light emitters.

25. The lighting apparatus according to claim 24, wherein the first elongated body structure comprises a first flexible body structure, and the second elongated body structure comprises a second flexible body structure.

26. The lighting apparatus according to claim 24, further comprising an AC plug in electrical communication with the at least one driver circuit component.

27. The lighting apparatus according to claim 1, further comprising at least one optical element comprising at least one of a lens and a diffuser arranged to receive emissions from each solid state light emitter of the array of solid state light emitters.

28. A light bulb or lighting fixture adapted to operate with alternating current (AC) received from an AC power source, the light bulb or lighting fixture comprising:

a base end;

a light-transmissive end opposing the base end;

an array of solid state light emitters including a plurality of individually controllable solid state light emitter sets each comprising multiple solid state light emitters, wherein at least two different solid state light emitter sets of the plurality of individually controllable solid state light emitter sets are arranged to be activated and/or deactivated at different times relative to one another during at least a positive portion of an AC cycle; and a reflector including a cavity and a reflective surface arranged to permit transmission of light reflected by the reflector toward the light-transmissive end;

wherein the array of solid state light emitters is arranged within the cavity to transmit emissions of the array of solid state light emitters toward the reflective surface; and wherein the array of solid state light emitters is arranged to emit light in a direction toward the base end to impinge on the reflective surface for reflection of light toward the light-transmissive end.

29. The light bulb or lighting fixture according to claim 28, wherein the reflector comprises a cup-shaped body or comprises a concave or convex cavity portion.

30. The light bulb or lighting fixture according to claim 28, wherein the reflective surface is diffusively reflective or specularly reflective.

31. The light bulb or lighting fixture according to claim 28, being devoid of any switched-mode power supply providing AC to DC conversion utility and arranged in electrical communication between the AC power source and the array of solid state light emitters.

32. A light bulb or lighting fixture adapted to operate with alternating current (AC) received from an AC power source, the light bulb or lighting fixture comprising:

a light-transmissive end;

an array of solid state light emitters including a plurality of individually controllable solid state light emitter sets each comprising multiple solid state light emitters, wherein at least two different solid state light emitter sets of the plurality of individually controllable solid state light emitter sets are arranged to be activated and/or deactivated at different times relative to one another during a period of AC waveform; and a reflector defining a cavity and comprising a reflective surface arranged to permit transmission of light reflected by the reflector toward the light-transmissive end;

wherein the array of solid state light emitters is arranged within the cavity to transmit emissions of the array of solid state light emitters toward the reflective surface; and wherein light emissions transmitted through the light-transmissive end comprise emissions reflected by the reflective surface and are devoid of direct emissions from the array of solid state light emitters.

33. The light bulb or lighting fixture according to claim 32, wherein the reflector comprises a cup-shaped body that defines the cavity.

34. The light bulb or lighting fixture according to claim 32, wherein the reflective surface is diffusively reflective or specularly reflective.

35. The light bulb or lighting fixture according to claim 32, being devoid of any switched-mode power supply providing AC to DC conversion utility and arranged in electrical communication between the AC power source and the array of solid state light emitters.

36. The lighting apparatus according to claim 1, wherein at least two different solid state light emitter sets of the plurality of electrically mutually exclusive solid state light emitter sets are arranged to be activated and/or deactivated at different times relative to one another during a negative portion of an AC cycle.

37. The lighting apparatus according to claim 13, wherein at least two different solid state light emitter sets of the plurality of electrically mutually exclusive solid state light emitter sets are arranged to be activated and/or deactivated at different times relative to one another during a negative portion of an AC cycle.

38. The lighting apparatus according to claim 20, wherein at least two different solid state light emitter sets of the plurality of electrically mutually exclusive solid state light emitter sets are arranged to be activated and/or deactivated at different times relative to one another during a negative portion of an AC cycle.

39. The lighting apparatus according to claim 22, wherein at least two different solid state light emitter sets of the plurality of electrically mutually exclusive solid state light emitter sets are arranged to be activated and/or deactivated at different times relative to one another during a negative portion of an AC cycle.

40. The lighting apparatus according to claim 24, wherein at least two different solid state light emitter sets of the first plurality of individually controllable solid state light emitter sets or the second plurality of individually controllable solid state light emitter sets are arranged to be activated and/or deactivated at different times relative to one another during a negative portion of an AC cycle.

* * * * *